US010883439B2

(12) United States Patent
Miwa et al.

(10) Patent No.: US 10,883,439 B2
(45) Date of Patent: Jan. 5, 2021

(54) INTERNAL COMBUSTION ENGINE

(71) Applicant: TOYOTA JIDOSHA KABUSHIKI KAISHA, Toyota (JP)

(72) Inventors: Koji Miwa, Sunto-gun (JP); Yusuke Suzuki, Hadano (JP); Kunihiko Usui, Fuji (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/413,666

(22) Filed: May 16, 2019

(65) Prior Publication Data

US 2019/0360447 A1 Nov. 28, 2019

(30) Foreign Application Priority Data

May 25, 2018 (JP) ..... 2018-101034

(51) Int. Cl.
*F02N 19/00* (2010.01)
*F02D 41/06* (2006.01)
(Continued)

(52) U.S. Cl.
CPC ..... *F02D 41/3094* (2013.01); *F02D 41/047* (2013.01); *F02D 41/062* (2013.01);
(Continued)

(58) Field of Classification Search
CPC .. F02N 19/001; F02D 41/1439; F02D 41/062; F02D 41/3094; F02D 41/047; F02D 35/026; F02D 41/3076
(Continued)

(56) References Cited

U.S. PATENT DOCUMENTS 5,482,023 A * 1/1996 Hunt ..... F02D 41/003 123/491
6,340,014 B1 * 1/2002 Tomita ..... F02D 41/3023 123/295
(Continued)

FOREIGN PATENT DOCUMENTS

JP 2001073854 A * 3/2001 ..... F02D 41/3094
JP 2005-307916 A 11/2005
(Continued)

*Primary Examiner* — Sizo B Vilakazi
*Assistant Examiner* — Brian R Kirby
(74) *Attorney, Agent, or Firm* — Oliff PLC

(57) ABSTRACT

An internal combustion engine is provided with a cylinder injector injecting fuel directly into a combustion chamber; an intake injector injecting fuel into an intake passage; and a control device controlling injection of fuel from these injectors. The control device is configured to perform a first control, in which an air-fuel mixture in the combustion chamber is formed by only fuel injected from the cylinder injector, until a predetermined timing after startup of the internal combustion engine, and to perform a second control, in which an air-fuel mixture in the combustion chamber is formed by fuel containing a larger amount of fuel injected from the intake injector than fuel injected from the cylinder injector, and after the predetermined timing. The air-fuel ratio of the mixture during the second control is smaller than the air-fuel ratio of the air-fuel mixture during the first control and smaller than the stoichiometric air-fuel ratio.

7 Claims, 13 Drawing Sheets

(51) Int. Cl.
*F02D 41/14* (2006.01)
*F02D 41/30* (2006.01)
*F02D 41/04* (2006.01)

(52) U.S. Cl.
CPC ..... *F02D 41/3076* (2013.01); *F02D 41/1439* (2013.01); *F02N 19/001* (2013.01)

(58) Field of Classification Search
USPC ..... 123/491, 492
See application file for complete search history.

(56) References Cited

U.S. PATENT DOCUMENTS 6,363,313 B1 * 3/2002 Katoh ..... F02D 41/02 701/104
6,959,693 B2 * 11/2005 Oda ..... F02D 41/064 123/431
7,201,146 B2 * 4/2007 Araki ..... F02D 41/30 123/431
2005/0005903 A1 * 1/2005 Maitani ..... F02D 41/062 123/301
2005/0235959 A1 * 10/2005 Sadakane ..... F02B 7/02 123/431
2005/0268889 A1 * 12/2005 Kojima ..... F02M 69/046 123/458
2006/0207562 A1 * 9/2006 Miyazaki ..... F02D 41/062 123/431
2006/0207567 A1 * 9/2006 Yamaguchi ..... F02D 41/3836 123/431
2009/0082937 A1 * 3/2009 Hokuto ..... F02D 41/0002 701/103
2010/0063710 A1 * 3/2010 Asai ..... F02D 41/403 701/103
2010/0242930 A1 * 9/2010 Shinohara ..... F02D 41/006 123/568.14
2014/0318501 A1 * 10/2014 Mitani ..... F02D 41/047 123/478
2015/0142297 A1 * 5/2015 Kojima ..... F02D 41/3076 701/104
2015/0240737 A1 * 8/2015 Surnilla ..... F02D 13/0207 123/435
2015/0285179 A1 * 10/2015 Cohn ..... F02D 41/3836 701/104
2016/0348623 A1 * 12/2016 Mitsuoka ..... F02M 51/04
2017/0045004 A1 * 2/2017 Naidu ..... F02B 63/04
2017/0138293 A1 * 5/2017 Moorcroft ..... F02D 41/008
2017/0328296 A1 * 11/2017 Kamio ..... F02D 41/047
2017/0356375 A1 * 12/2017 Glugla ..... B60W 30/1882

FOREIGN PATENT DOCUMENTS

JP 2005330833 A * 12/2005
JP 2010255441 A * 11/2010 ..... F02D 41/3094
JP 2014172540 A * 9/2014 ..... F02D 41/3094

* cited by examiner

INTERNAL COMBUSTION ENGINE

FIELD

The present invention relates to an internal combustion engine.

BACKGROUND

Known in the past has been an internal combustion engine provided with a cylinder injector directly injecting fuel into a combustion chamber and an intake injector injecting fuel into an intake port or other pan of an intake passage (for example, PTL 1).

In such an internal combustion engine, it has been proposed to control these injectors so that at the time of startup of the internal combustion engine, first fuel is injected from the cylinder injector, then fuel is injected from the intake injector (PTL 1). By performing such control, it is considered possible to secure an excellent engine startup property and to keep unburned constituents from being exhausted at the time of engine startup.

CITATION LIST

Patent Literature

[PTL 1] Japanese Unexamined Patent Publication No. 2005-307916

SUMMARY

Technical Problem

In this regard, when stopping an internal combustion engine, the internal combustion engine operates for a certain extent even after fuel has stopped being injected from the injectors. Therefore, when stopping an internal combustion engine, an exhaust purification catalyst arranged in an exhaust passage of the internal combustion engine stores a large amount of oxygen. To enable the exhaust purification catalyst to purify exhaust gas well even after restart of the internal combustion engine, it is necessary to discharge the oxygen stored in the exhaust purification catalyst when restarting the internal combustion engine.

To discharge the oxygen stored in the exhaust purification catalyst when restarting the internal combustion engine, it may be considered to render the air-fuel ratio of the exhaust gas flowing into the exhaust purification catalyst a rich air-fuel ratio richer than a stoichiometric air-fuel ratio over a certain extent of time after restart of the internal combustion engine. By exhaust gas of a rich air-fuel ratio flowing into the exhaust purification catalyst in this way, the oxygen which was stored in the exhaust purification catalyst is discharged from the exhaust purification catalyst and reacts with, for example, the unburned HC in the exhaust gas. As a result, it is possible to raise the purification ability of the exhaust purification catalyst.

However, as explained above, in an internal combustion engine provided with a cylinder injector and intake injector, at the time of startup of the internal combustion engine, first fuel is injected from the cylinder injector. However, when injecting fuel from the cylinder injector, as explained above, if injecting a large amount of fuel so that the air-fuel ratio of the exhaust gas becomes a rich air-fuel ratio, the fuel is unevenly mixed and accordingly a large amount of particulate matter is produced by combustion of the air-fuel mixture.

On the other hand, it may also be considered to not inject fuel from the cylinder injector at the time of startup of the internal combustion engine, but inject fuel from only the intake injector. However, since a certain extent of time is taken until fuel injected from the intake injector burns in the combustion chamber, startup of the internal combustion engine takes time and the engine startup property deteriorates.

The present invention was made in consideration of the above problem and has as its object to secure the engine startup property in an internal combustion engine while keeping particulate matter from being produced along with combustion of the air-fuel mixture.

Solution to Problem

The present invention was made so as to solve the above problem and has as its gist the following.

(1) An internal combustion engine comprising: a cylinder injector injecting fuel directly into a combustion chamber; an intake injector injecting fuel into an intake passage; and a control device controlling injection of fuel from these injectors, wherein, the control device is configured to perform a first control, in which an air-fuel mixture in the combustion chamber is formed by only fuel injected from the cylinder injector, until a predetermined timing after startup of the internal combustion engine, and to perform a second control, in which an air-fuel mixture in the combustion chamber is formed by fuel containing a larger amount of fuel injected from the intake injector than fuel injected from the cylinder injector, at and alter the predetermined timing, and the air-fuel ratio of the air-fuel mixture during the second control is smaller than the air-fuel ratio of the air-fuel mixture during the first control and smaller than the stoichiometric air-fuel ratio.

(2) The internal combustion engine according to above (1), wherein during the second control, the air-fuel mixture in the combustion chamber is formed by only fuel injected from the intake injector.

(3) The internal combustion engine according to above (1), wherein the air-fuel ratio of the air-fuel mixture during the first control is substantially the stoichiometric air-fuel ratio.

(4) The internal combustion engine according to any one of above (1) to (3), wherein the predetermined timing is the timing at which one cycle is completed after startup of the internal combustion engine, and the control device is configured so as to form an air-fuel mixture in the combustion chamber by the first control during the first cycle after startup of the internal combustion engine, and so as to form an air-fuel mixture in the combustion chamber by the second control on and after the second cycle after startup of the internal combustion engine.

(5) The internal combustion engine according to any one of above (1) to (3), wherein the predetermined timing is a timing before an air-fuel mixture is formed by fuel injected from the intake injector right after engine startup, and the control device is configured to perform the first control before an air-fuel mixture in the combustion chambers is formed by fuel injected from the intake injector right after engine startup, and perform second control after an air-fuel mixture in the combustion chambers is formed by fuel injected from the intake injector right after engine startup.

(6) The internal combustion engine according to any one of above (1) to (3), wherein the control device is configured so as to be able to perform first startup injection control performing the first control during one cycle after startup of the internal combustion engine and performing the second control at the second cycle on and after startup of the internal combustion engine, and second startup injection control performing the first control before an air-fuel mixture in the combustion chamber is formed by fuel injected from the intake injector right after engine startup and performing second control after an air-fuel mixture in the combustion chamber is formed by fuel injected from the intake injector right after engine startup, and is configured to perform one of the first startup injection control and the second startup injection control at the time of startup of the internal combustion engine according to the state of the internal combustion engine at the time of startup of the internal combustion engine.

(7) The internal combustion engine according to any one of above (1) to (6), wherein the control device is configured so as to perform the second control so that an end timing of the second control is later as the wall surface temperature of the combustion chamber of the internal combustion engine at the time of startup of the internal combustion engine is lower.

(8) The internal combustion engine according to any one of above (1) to (7), wherein the control device is configured so as to determine an end timing of the second control in accordance with a total fuel injection amount from the two injectors after startup of the internal combustion engine.

(9) The internal combustion engine according to any one of above (1) to (8), wherein the control device is configured so that when, at the time of startup of the internal combustion engine, it is estimated that the temperature of the wall surface of the combustion chamber of the internal combustion engine is equal to or higher than a predetermined temperature, the second control is not performed after startup of the internal combustion engine.

Advantageous Effects of Invention

According to the present invention, it is possible to secure the engine startup property in an internal combustion engine while keeping particulate matter from being produced along with combustion of the air-fuel mixture.

DESCRIPTION OF EMBODIMENTS

Figure 1:
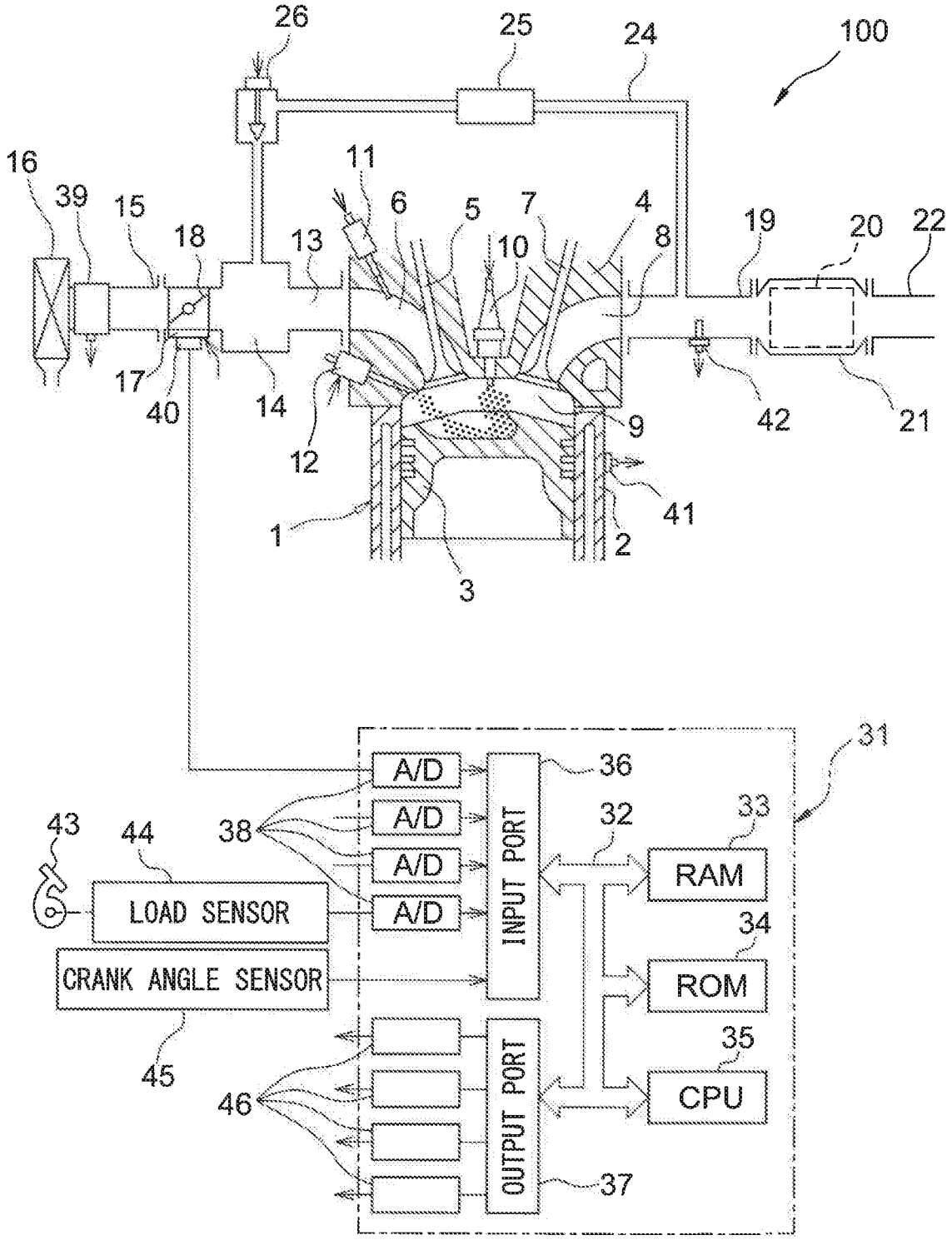
FIG. 1 is a view schematically showing an internal combustion engine according to the present embodiment.

Below, referring to the drawings, embodiments of the present invention will be explained in detail. Note that, in the following explanation, similar components are assigned the same reference notations.

First Embodiment

Explanation of Internal Combustion Engine Overall

FIG. 1 is a view schematically showing an internal combustion engine according to a first embodiment in which a control device is used. As shown in FIG. 1, the engine body 1 of the internal combustion engine 100 is provided with a cylinder block 2, pistons 3 reciprocating in a cylinder of the cylinder block 2, a cylinder head 4 fastened on the cylinder block 2, intake valves 5, intake ports 6, exhaust valves 7, and exhaust ports 8. Between the piston 3 and the cylinder head 4, a combustion chamber 9 is formed. The intake valves 5 open and close the intake port 6, while the exhaust valves 7 open and close the exhaust port 8. Further, the engine body 1 may be provided with a variable intake valve timing mechanism controlling a valve timing of the intake valve 5 and/or a variable exhaust valve timing mechanism controlling the valve timing of the exhaust valve 7. Note that, the internal combustion engine 100 according to the present embodiment is a four-cylinder inline internal combustion engine having four cylinders, but may also be a six-cylinder V-engine or other type of internal combustion engine.

As shown in FIG. 1, at the center part of the inner wall surface of the cylinder head 4, a spark plug 10 is arranged. The spark plug 10 is configured so as to generate a spark in accordance with an ignition signal. Further, near the intake port 6 of the cylinder head 4, an intake injector 11 injecting fuel into the intake port 6 is provided, in addition, near the outer circumference of the combustion chamber of the cylinder head 4, a cylinder injector 12 directly injecting fuel into the combustion chamber 9 is provided. Note that, the intake injector 11 may be configured so as to inject fuel to an intake runner 13 or other part of the intake passage other than the intake port 6.

The intake port 6 of each cylinder is connected through a respectively corresponding intake runner 13 to a surge tank 14. The surge tank 14 is connected through an intake pipe 15 to an air cleaner 16. The intake ports 6, intake runners 13, surge tank 14, and intake pipe 15 form an intake passage. Further, in the intake pipe 15, a throttle valve 18 driven by a throttle valve drive actuator 17 is arranged.

On the other hand, the exhaust port 8 of each cylinder is connected to an exhaust manifold 19. The exhaust manifold 19 is connected to a casing 21 housing an exhaust purification catalyst 20. The casing 21 is connected to an exhaust pipe 22. The exhaust port 8, exhaust manifold 19, casing 21, and exhaust pipe 22 form an exhaust passage.

The exhaust manifold 19 and the surge tank 14 are connected with each other by an EGR pipe 24. At the EGR pipe 24, an EGR cooler 25 for cooling the EGR gas flowing from the exhaust manifold 19 to the surge tank 14 through the EGR pipe 24 is provided. In addition, at the EGR pipe 24, an EGR control valve 26 for controlling the flow rate of EGR gas supplied to the surge tank 14 is provided. The EGR pipe 24, EGR cooler 25, and EGR control valve 26 constitute the EGR mechanism for feeding part of the exhaust gas to the intake passage.

Further, the internal combustion engine 100 is provided with an electronic control unit (ECU) 31. The ECU 31 is provided with a RAM (random access memory) 33, ROM (read only memory) 34, CPU (microprocessor) 35, input port 36, and output port 37. These are connected with each other through the bidirectional bus 32.

At the intake pipe 15, an air flow meter 39 for detecting the flow rate of air flowing through the intake pipe 15 is provided. At the throttle valve 18, a throttle opening degree sensor 40 for detecting the opening degree of the throttle valve 18 is provided. In addition, at the cylinder block 2, a temperature sensor 41 for detecting the temperature of the cooling water flowing through the engine body 1 is provided, while at the exhaust manifold 19, an air-fuel ratio sensor 42 for detecting the air-fuel ratio of the exhaust gas (below, "exhaust air-fuel ratio") flowing through the exhaust manifold 19 is provided. The outputs of these air flow meter 39, throttle opening degree sensor 40, temperature sensor 41, and air-fuel ratio sensor 42 are input through corresponding AD converters 38 to the input port 36.

Further, at an accelerator pedal 43, a load sensor 44 for generating an output voltage proportional to the amount of depression of the accelerator pedal 43 is connected. The output voltage of the load sensor 44 is input as a signal showing the engine load through a corresponding AD converter 38 to the input port 36. A crank angle sensor 45 generates an output pulse every time for example a crankshaft rotates by 10 degrees. The output pulses are input to the input port 36. At the CPU 35, the engine rotational speed is calculated from the output pulse of the crank angle sensor 45.

On the other hand, the output port 37 is connected through a corresponding drive circuit 46 to the spark plugs 10, intake injectors 11, cylinder injectors 12, and throttle valve drive actuators 17. Therefore, the ECU 31 functions as a control device for controlling the ignition timing by the spark plug 10, the fuel injection timings and the fuel injection amounts from the intake injectors 11 and cylinder injectors 12, the opening degree of the throttle valve 18, etc.

Properties of Exhaust Purification Catalyst

The exhaust purification catalyst 20 is a three-way catalyst having an oxygen storage ability. Specifically, the exhaust purification catalyst 20 is a three-way catalyst comprised of a support made of ceramic on which a catalyst precious metal having a catalytic action (for example, platinum (Pt)) and a substance having an oxygen storage ability (for example, ceria ($CeO_2$)) are carried. The three-way catalyst has the function of simultaneously removing unburned HC, CO and $NO_X$ if the air-fuel ratio of the exhaust gas flowing into the three-way catalyst is maintained at the stoichiometric air-fuel ratio. In addition, if a certain extent of oxygen is stored in the exhaust purification catalyst 20, unburned HC, CO and $NO_X$ are simultaneously removed even if the air-fuel ratio of the exhaust gas flowing into the exhaust purification catalyst 20 deviates somewhat from the stoichiometric air-fuel ratio to the rich side or the lean side.

That is, if the exhaust purification catalyst 20 has an oxygen storage ability, that is, if the oxygen storage amount of the exhaust purification catalyst 20 is smaller than the maximum storable oxygen amount, when the air-fuel ratio of the exhaust gas flowing into the exhaust purification catalyst 20 deviates from the stoichiometric air-fuel ratio to be somewhat lean, the excess oxygen contained in the exhaust gas is stored in the exhaust purification catalyst 20. Therefore, atmosphere on the surface of the exhaust purification catalyst 20 is maintained at the stoichiometric air-fuel ratio. As a result, on the surface of the exhaust purification catalyst 20, unburned HC, CO and $NO_X$ are simultaneously removed. At this time, the air-fuel ratio of the exhaust gas flowing out from the exhaust purification catalyst 20 becomes the stoichiometric air-fuel ratio.

On the other hand, if the exhaust purification catalyst 20 is in a state able to release oxygen, that is, if the oxygen storage amount of the exhaust purification catalyst 20 is larger than 0, when the air-fuel ratio of the exhaust gas flowing into the exhaust purification catalyst 20 is somewhat richer than the stoichiometric air-fuel ratio, the amount of oxygen still required for reducing the unburned HC and CO contained in the exhaust gas is released from the exhaust purification catalyst 20. Therefore, in this case as well, the surface of the exhaust purification catalyst 20 is maintained at the stoichiometric air-fuel ratio. As a result, on the surface of the exhaust purification catalyst 20, unburned HC, CO and $NO_X$ are simultaneously removed. At this time, the air-fuel ratio of the exhaust gas flowing out from the exhaust purification catalyst 20 becomes the stoichiometric air-fuel ratio.

In this way, if the exhaust purification catalyst 20 stores a certain extent of oxygen, even if the air-fuel ratio of the exhaust gas flowing into the exhaust purification catalyst 20 deviates somewhat from the stoichiometric air-fuel ratio to the rich side or lean side, the unburned HC, CO and $NO_X$ are simultaneously removed and the air-fuel ratio of the exhaust gas flowing out from the exhaust purification catalyst 20 becomes the stoichiometric air-fuel ratio.

Usual Injection Control

Figure 2:
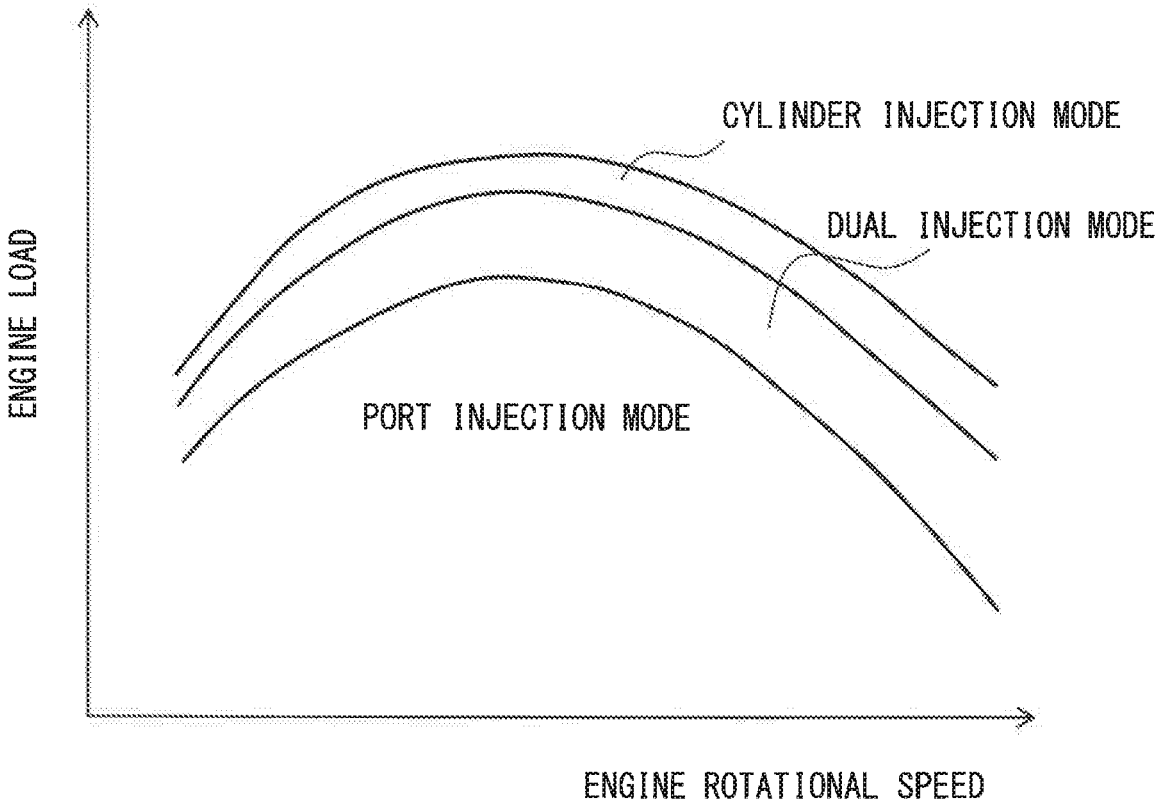
FIG. 2 is a view showing a relationship between an engine rotational speed and engine load for different injection modes.

Next, referring to FIGS. 2 and 3, control of fuel injection from the injectors 11, 12 during usual operation of the internal combustion engine 100 (not during engine startup operation) will be explained. FIG. 2 is a view showing a relationship between an engine rotational speed and engine load for different injection modes. In FIG. 2, a "port injection mode" is an injection mode in which fuel is injected only from the intake injector 11. Further, a "dual injection mode" is an injection mode in which fuel is injected from both the intake injector 11 and cylinder injector 12. In addition, a "cylinder injection mode" is an injection mode in which fuel is injected from only the cylinder injector 12.

As shown in FIG. 2, at each engine rotational speed, when the engine load is low, fuel is injected by the port injection mode. On the other hand, at each engine rotational speed, when the engine load is high, fuel is injected by the cylinder injection mode. Further, when the engine load is a load between these, fuel is injected by the dual injection mode.

In this regard, if the fuel is injected from the intake injector 11, a certain extent of time can be secured near compression top dead center until it burns. Therefore, the fuel injected from the intake injector 11 is higher in homogeneity of the air-fuel mixture, compared with fuel injected from the cylinder injector 12. In the present embodiment, when the engine load is low, fuel is injected by the port injection mode, and therefore the homogeneity of the air-fuel mixture can be raised and accordingly the air-fuel mixture can be burned well.

On the other hand, the fuel injected by the cylinder injection mode vaporizes in the combustion chamber 9, and therefore the air-fuel mixture is cooled by the latent heat of vaporization. For this reason, if injecting fuel from the cylinder injector 12, compared with injecting fuel from the intake injector 11, it is possible to lower the temperature in the combustion chamber 9 near compression top dead center. In this regard, when the engine load is high, the amount of intake gas charged into the combustion chamber 9 is great and the temperature of the air-fuel mixture at compression top dead center is high. In the present embodiment, when the engine load is high, fuel is injected by the cylinder injector 12. As a result, it is possible to suppress knocking while increasing the amount of intake gas charged into the combustion chamber 9 and therefore it is possible to improve the output of the internal combustion engine 100.

Figure 3:
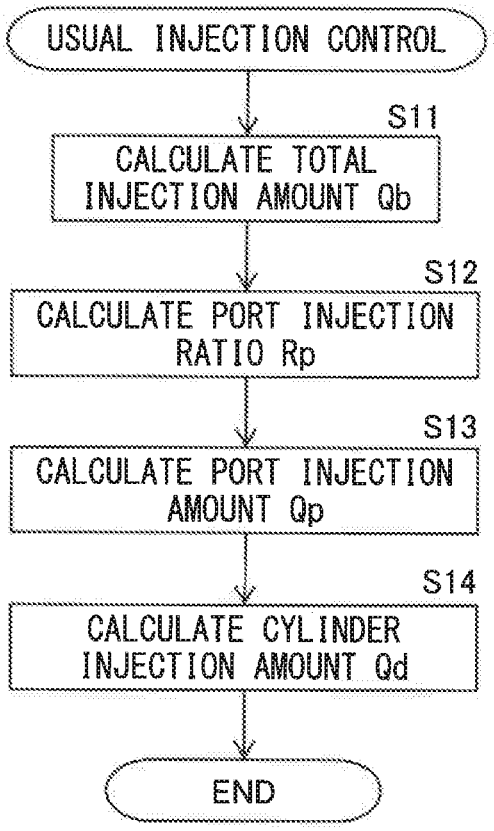
FIG. 3 is a flow chart showing a control routine of normal injection control performed during usual operation of an internal combustion engine.

FIG. 3 is a flow chart showing a control routine of usual injection control performed during usual operation of the internal combustion engine 100. The illustrated control routine is, for example, performed each time the control routine reaches step S40 in the later explained flow charts of FIGS. 6 and 7.

First, at step S11, the total fuel injection amount Qb from the intake injector 11 and cylinder injector 12 is calculated. The total fuel injection amount Qb is, for example, calculated based on the engine load detected by the load sensor 44 and the engine rotational speed calculated based on the output of the crank angle sensor 45. In addition to these or in place of part of these, the total fuel injection amount Qb may be calculated based on values of other parameter, such as the opening degree of the throttle valve 18 detected by the throttle opening degree sensor 40.

Next, at step S12, the ratio Rp of the amount of fuel injection from the intake injector 11 to the total fuel injection amount (below, also referred to as the "port injection ratio") is calculated. The port injection ratio Rp is calculated based on the engine load and engine rotational speed using a map such as shown in FIG. 2. In the region of the port injection mode of FIG. 2, the port injection ratio Rp is calculated as "1" while in the region of the cylinder injection mode, the port injection ratio Rp is calculated as "0".

Next, at step S13, the amount of fuel Qp to be injected from the intake injector 11 (below, also referred to as the "port injection amount") is calculated by the following formula (1). Further, at step S14, the amount of fuel Qd to be injected from the cylinder injector 12 (below, also referred to as the "cylinder injection amount") is calculated by the following formula (2):

$$Qp = Rp \times (Qb + \Delta Q) \quad (1)$$

$$Qd = (1 - Rp) \times (Qb + \Delta Q) \quad (2)$$

Note that, in the above formulas (1) and (2), ΔQ is any correction amount and is set based on, for example, the control of the air-fuel ratio of the internal combustion engine 100. In particular, in the present embodiment, the correction amount ΔQ is calculated by the control routine shown in FIGS. 6 and 7.

Injection Control at Engine Startups

In this regard, fuel has to be injected from the intake injector 11 before intake gas is sucked into the combustion chamber 9. Therefore, fuel is injected from the intake injector 11 from the exhaust stroke to the first half of the intake stroke of the corresponding cylinder. Therefore, at the time of startup of the internal combustion engine 100, if injecting fuel from the intake injector 11, time is taken until the first injected fuel burns and the startup property of the internal combustion engine 100 falls.

On the other hand, fuel is directly injected from the cylinder injector 12 into the combustion chamber 9 during the compression stroke. Therefore, fuel is injected from the cylinder injector 12 in the compression stroke right before compression top dead center where the air-fuel mixture is ignited. For this reason, if injecting fuel from the cylinder injector 12 at the time of startup of the internal combustion engine, it is possible to make the first injected fuel burn right after engine startup. Accordingly, the startup property of the internal combustion engine 100 is improved.

However, at the time of startup of the internal combustion engine 100, usually the temperature of the wall surfaces defining the combustion chamber 9 (top surface of piston 3, bottom surface of cylinder head 4, etc.) (below, also referred to as the "wall surface temperature of the combustion chamber") is low. If the internal combustion engine 100 intermittently stops due to the engine being designed to have idle reduction function, the cooling water flowing through the internal combustion engine 100 will sometimes be maintained as is at a relatively high temperature, but the wall surfaces of the combustion chamber 9 even in such a case will fall in temperature a certain extent. If injecting fuel from the cylinder injector 12 in the state where the wall surface temperature of the combustion chamber 9 falls in this way, the injected fuel becomes hard to vaporize and regions with high concentrations of fuel are formed in part. If the air-fuel mixture burns in the state containing regions with high concentrations of fuel in this way, the amount of particulate matter produced along with combustion of the air-fuel mixture increases and the exhaust emission is deteriorated.

As opposed to this, the fuel injected from the intake injector 11 is sufficiently mixed with the air since even if the wall surface temperature of the combustion chamber 9 is low, there is sufficient time from injection to ignition. Therefore, even at the time of startup of the internal combustion engine, if injecting fuel from the intake injector 11, it is possible to keep down production of particulate matter accompanying combustion of the air-fuel mixture and accordingly possible to keep down deterioration of the exhaust emission.

Therefore, in the present embodiment, at the time of startup of the internal combustion engine 100, startup injection control different from the usual injection control is performed. In the present embodiment, in startup injection control, a first control is performed to supply fuel into the combustion chamber 9 to form an air-fuel mixture in the combustion chamber 9 by fuel injection from the cylinder injector 12 in only the first cycle after startup of the internal combustion engine 100. In addition, a second control is performed to supply fuel into the combustion chamber 9 to form an air-fuel mixture in the combustion chamber 9 by fuel injection from the intake injector U in or after the second cycle after startup of the internal combustion engine 100. By selectively using the intake injector 11 and cylinder injector 12 in startup injection control in this way at the time of startup of the internal combustion engine 100, it is possible to keep the startup property of the internal combustion engine 100 high while suppressing deterioration of the exhaust emission.

In this regard, when stopping the internal combustion engine 100, even after stopping the fuel injection from the intake injector 11 and cylinder injector 12, the crankshaft of the internal combustion engine 100 continues turning due to inertia. During that time, at the engine body 1, the air sucked into the combustion chamber 9 is discharged therefrom as it is and air flows into the exhaust purification catalyst 20.

If air flows into the exhaust purification catalyst 20 in this way, the exhaust purification catalyst 20 will store a large amount of oxygen, therefore the oxygen storage amount of the exhaust purification catalyst 20 will reach near the maximum storable amount of oxygen beyond which oxygen will no longer be able to be stored. In such a state, even if the internal combustion engine 100 is restarted and exhaust gas containing $NO_X$ somewhat leaner than the stoichiometric air-fuel ratio flows into the exhaust purification catalyst 20, oxygen will no longer be able to be further stored at the exhaust purification catalyst 20 and accordingly the $NO_X$ cannot be removed.

Therefore, in the present embodiment, at the time of startup of the internal combustion engine 100, basically, the fuel injection amounts from the injectors 11, 12 are controlled so that the air-fuel ratio of the exhaust gas discharged from the engine body 1 is an air-fuel ratio richer than the stoichiometric air-fuel ratio (below, also referred to as a "rich air-fuel ratio"). By exhaust gas of a rich air-fuel ratio flowing into the exhaust purification catalyst 20, the oxygen stored in the exhaust purification catalyst 20 and the unburned HC, CO contained in the exhaust gas react. As a result, it is possible to reduce the oxygen storage amount of the exhaust purification catalyst 20.

In this regard, as explained above, in the present embodiment, fuel is supplied into the combustion chamber 9 by fuel injection from the cylinder injector 12 only in the first cycle after startup of the internal combustion engine 100 by the first control, while fuel is supplied into the combustion chamber 9 by fuel injection from the intake injector 11 by the second control in or after the second cycle. In the present embodiment, in supplying fuel so that the air-fuel ratio of the exhaust gas is the rich air-fuel ratio, fuel is injected so that the air-fuel ratio of the air-fuel mixture supplied into the combustion chamber 9 is substantially the stoichiometric air-fuel ratio during the first control at the first cycle after startup of the internal combustion engine 100. In addition, during the second control in or after the second cycle, fuel is injected so that the air-fuel ratio of the air-fuel mixture becomes a rich air-fuel ratio. Therefore, in the present embodiment, during the first control of the first cycle, the air-fuel ratio of the exhaust gas becomes substantially the stoichiometric air-fuel ratio and during the second control at and after the second cycle, the air-fuel ratio of the exhaust gas becomes the rich air-fuel ratio.

Figure 4:
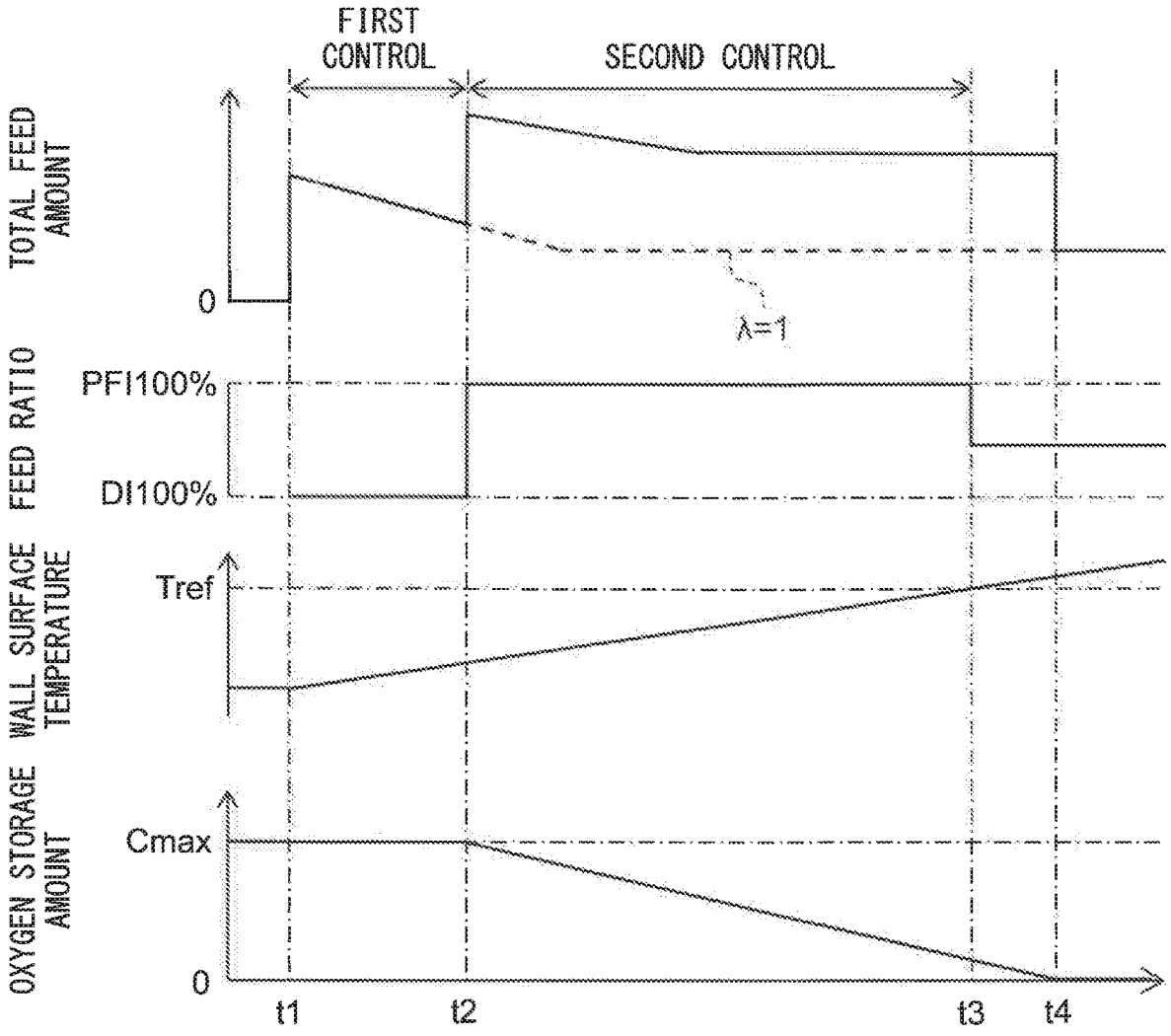
FIG. 4 is a time chart of a total fuel feed amount and other parameters, at the time of startup of an internal combustion engine.

Below, referring to FIGS. 4 and 5, a specific example of fuel injection control at the time of startup of the internal combustion engine 100 will be explained. FIG. 4 is a time chart of a total fuel feed amount, fuel feed ratio, wall surface temperature of the combustion chamber 9, and oxygen storage amount of the exhaust purification catalyst 20 at the time of startup of the internal combustion engine 100. The broken line in the total fuel feed amount of FIG. 4 shows the fuel feed amount with an equivalent ratio λ of 1. Therefore, when the total fuel feed amount from the two injectors 11, 12 is an amount on the broken line, the air-fuel ratio of the exhaust gas discharged from the engine body 1 is substantially the stoichiometric air-fuel ratio.

In the example shown in FIG. 4, when stopping the internal combustion engine 100, the exhaust purification catalyst 20 stores oxygen. Therefore, before the time t1 at which the internal combustion engine 100 is started up, the oxygen storage amount of the exhaust purification catalyst 20 is the maximum storable oxygen amount Cmax. In addition, while the internal combustion engine 100 is stopped, the wall surface temperature of the combustion chamber 9 falls, and therefore before the time t1, the wall surface temperature of the combustion chamber 9 is a relatively low temperature.

Right alter the time t1 at which the internal combustion engine 100 is started up, due to the first control, fuel is supplied into the combustion chamber 9 by fuel injection from only the cylinder injector 12. That is, after the time t1, the ratio of fuel feed from the cylinder injector 12 is 100%. As a result, it is possible to improve the startup property of the internal combustion engine 100 as explained above.

Further, after the time t1, the fuel injection amount from the cylinder injector 12 is set so that the air-fuel ratio of the air-fuel mixture supplied to the combustion chamber 9 is substantially the stoichiometric air-fuel ratio. Therefore, after the time t1, the total fuel feed amount from the two injectors 11, 12 is a feed amount with an equivalent ratio λ of 1. As a result, the air-fuel ratio of the exhaust gas discharged from the engine body 1 is substantially the stoichiometric air-fuel ratio and the oxygen storage amount of the exhaust purification catalyst 20 is maintained al the maximum storable oxygen amount Cmax. In addition, after the time t1, the air-fuel mixture is burned in the combustion chamber 9, and therefore the wall surface temperature of the combustion chamber 9 gradually rises. Note that, the total fuel teed amount with an equivalent ratio λ of 1 (broken line in FIG. 4) is the greatest right after engine startup at the time 11 and then gradually decreases. This is because right after engine startup, the negative pressure in the intake port 6 is low and accordingly a large amount of air is sucked into the combustion chamber 9.

After the time t2 on which one cycle after startup of the internal combustion engine 100 ends, the second control is performed, and thus fuel is supplied into the combustion chamber 9 by fuel injection from only the intake injector 11. That is, after the time t2, the ratio of feed of fuel from the intake injector 11 is 100%. As a result, as explained above, deterioration of the exhaust emission can be suppressed.

Further, after the time t2, the fuel injection amount from the intake injector 11 is set so that the air-fuel ratio of the exhaust gas discharged from the engine body 1 is a rich air-fuel ratio. Therefore, after the time t2, the total fuel feed amount from the two injectors 11, 12 is a feed amount where the equivalent ratio λ is a value larger than 1. As a result, the air-fuel ratio of the exhaust gas discharged from the engine body 1 is a rich air-fuel ratio. After the time t2, the oxygen storage amount of the exhaust purification catalyst 20 gradually decreases. Note that, the total fuel feed amount gradually decreases over a certain extent of time from the time t2, because the fuel injection amount from the intake injector 11 is set larger in consideration of the fact that part of the fuel injected from the intake injector 11 deposits on the wall surfaces of the intake port 6.

The air-fuel mixture burns in the combustion chamber 9 after the time t2, and therefore the wall surface temperature of the combustion chamber 9 gradually rises and eventually reaches the reference temperature Tref at the time t3. This reference temperature Tref is a temperature where if beyond this temperature, the fuel injected from the cylinder injector 12 sufficiently vaporizes, the variation in concentration of fuel in the air-fuel mixture is suppressed, and accordingly the amount of production of particulate mailer accompanying combustion of the air-fuel mixture is equal to or less than a certain amount.

At the time t3, if the wall surface temperature of the combustion chamber 9 reaches the reference temperature Tref, even if injecting fuel from the cylinder injector 12, the fuel will sufficiently vaporize, and therefore fuel injection from only the intake injector 11 is ended. Therefore, after the time t3, usual injection control is performed and accordingly fuel injection from the two injectors 11, 12 is controlled in accordance with the engine operating state based on the map shown in FIG. 2.

Then, after the time t4, if the oxygen storage amount of the exhaust purification catalyst 20 becomes substantially zero, the total fuel feed amount from the two injectors 11, 12 is set so that the air-fuel ratio of the air-fuel mixture is substantially the stoichiometric air-fuel ratio. Therefore, after the time t4, the total fuel feed amount from the two injectors 11, 12 is a feed amount where the equivalent ratio λ is substantially 1. As a result, the air-fuel ratio of the exhaust gas discharged from the engine body 1 is substantially the stoichiometric air-fuel ratio. After the time t4, the oxygen storage amount of the exhaust purification catalyst 20 is maintained at substantially zero.

Figure 5:
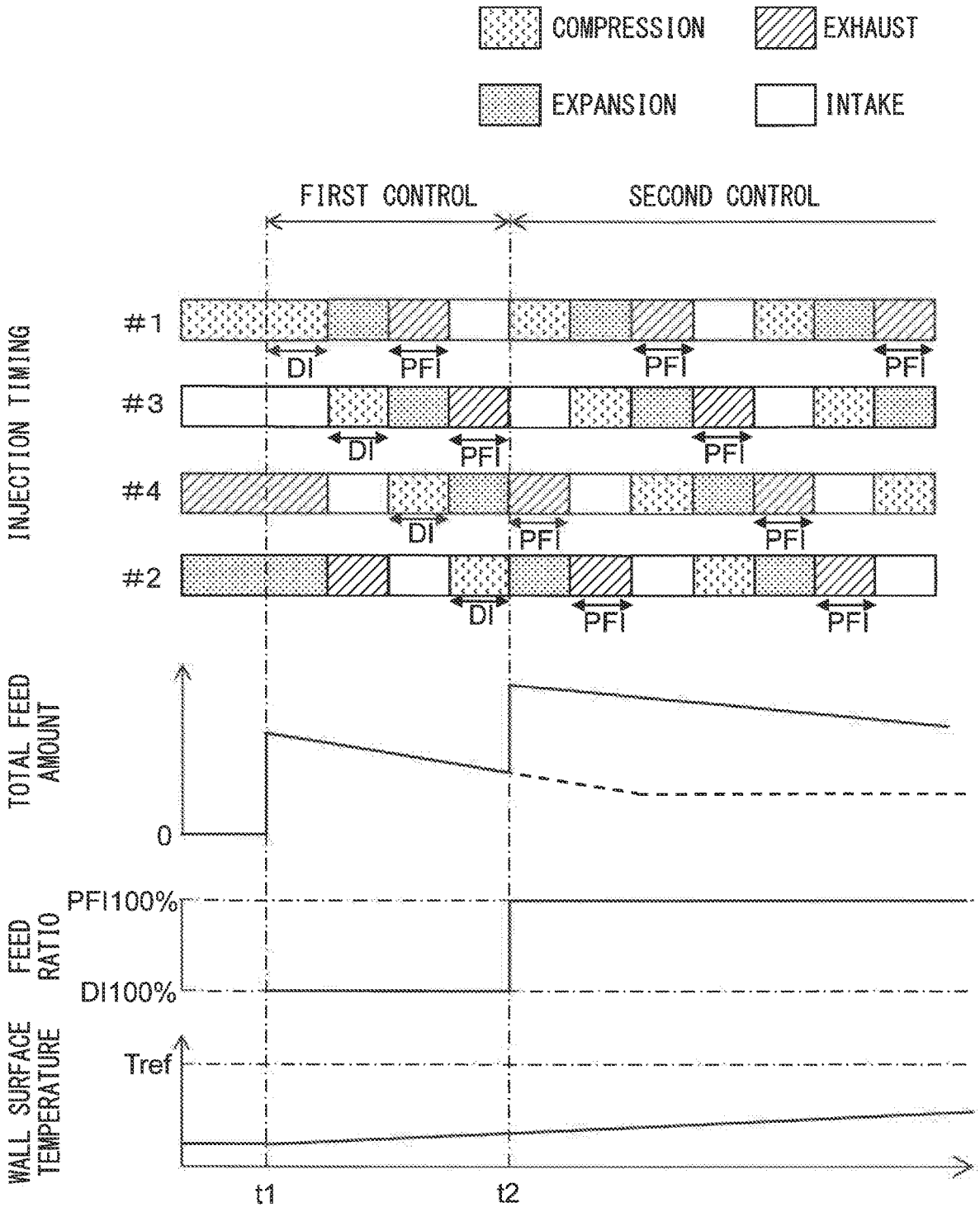
FIG. 5 is a time chart of fuel injection timing and other parameters, at an initial stage of startup of an internal combustion engine.

FIG. 5 is a time chart of fuel injection timing, total fuel feed amount, fuel feed ratio, and wall surface temperature of a combustion chamber 9 at the initial stage of startup of the internal combustion engine 100. "DI" at the fuel injection timing of FIG. 5 shows the fuel injection timing by the cylinder injector 12, while "PFI" shows the fuel injection timing by the intake injector 11. Further, the broken line in the total fuel feed amount of FIG. 5 shows the fuel feed amount where the equivalent ratio λ is 1.

In the example shown in FIG. 5, in the same way as the example shown in FIG. 4, the internal combustion engine 100 is started up at the time t1. In the illustrated example, at the time t1, the No. 1 cylinder #1 is in the compression stroke, the No. 3 cylinder #3 is in the intake stroke, the No. 4 cylinder #4 is in the exhaust stroke, and the No. 2 cylinder #2 is in the expansion stroke.

If at the time t1 the internal combustion engine 100 is started up, first, the first control is performed. Therefore, fuel is injected from the cylinder injector 12 at the No. 1 cylinder #3 which was in the compression stroke when the internal combustion engine 100 was stopped. Therefore, at this time, fuel injected from the cylinder injector 12 is fed to the combustion chamber 9 of the No. 1 cylinder #1. Further, the fuel injection amount at this time is set so that the air-fuel mixture in the combustion chamber 9 is substantially the stoichiometric air-fuel ratio. An air-fuel mixture containing fuel supplied to the combustion chamber 9 in this way is ignited near compression lop dead center by the spark plug 10.

Next, when the No. 3 cylinder #3 enters the compression stroke along with operation of the internal combustion engine 100, fuel is injected from the cylinder injector 12 at the No. 3 cylinder #3. Therefore, fuel injected from the cylinder injector 12 is supplied to the combustion chamber 9 of the No. 3 cylinder #3. Then, in the same way, when the No. 4 cylinder #4 enters the compression stroke, fuel is injected from the cylinder injector 12 at the No. 4 cylinder #4, while when the No. 2 cylinder #2 enters the compression stroke, fuel is injected from the cylinder injector 12 at the No. 2 cylinder #2. The fuel injection amount at the fuel injection from each of these cylinder injectors 12 is set so that the air-fuel mixture in the combustion chamber 9 becomes substantially the stoichiometric air-fuel ratio.

On the other hand, in the present embodiment, as explained above, the first control is performed for supplying fuel into the combustion chamber 9 by fuel injection from the cylinder injector 12 only at the first cycle after startup of the internal combustion engine 100. Further, in and after the second cycle after startup of the internal combustion engine 100, the second control is performed for supplying fuel into the combustion chamber 9 by fuel injection from the intake injector 11. Therefore, if the fuel injection from the cylinder injector 12 at the first cycle is completed, that is, in the example shown in FIG. 5, if fuel is injected from the cylinder injector 12 at the No. 2 cylinder #2, then, fuel is not injected from the cylinder injector 12 at any cylinder. Instead, fuel starts to be injected from the intake injector 11.

In this regard, fuel is injected from the intake injector 11 basically from the exhaust stroke to the intake stroke. Therefore, as shown in FIG. 5, when the No. 4 cylinder #4 is in the compression stroke of the first cycle and fuel is injected from the cylinder injector 12 in the No. 4 cylinder #4, fuel is also injected from the intake injector 11 at the No. 1 cylinder #1 in the exhaust stroke. Fuel injected from the intake injector 11 is supplied to the combustion chamber 9 of the No. 1 cylinder #1 in the second cycle.

Next when the No. 2 cylinder #2 is in the compression stroke of the first cycle and fuel is injected from the intake injector 11 at the No. 2 cylinder #2, fuel is also injected from the intake injector 11 at the No. 3 cylinder #3 in the exhaust stroke. As a result, fuel injected from the intake injector 11 is supplied to the combustion chamber 9 of the No. 3 cylinder #3 in the second cycle. Then, in each cylinder, fuel is injected from the intake injector 11 during the exhaust stroke. As a result, after the time t2, that is, at and alter the second cycle, fuel injected from the intake injector 11 is supplied to the combustion chamber 9. Further, the fuel injection amount in the fuel injection from each of the intake injectors 11 is set so that the air-fuel mixture in the combustion chamber 9 is a rich air-fuel ratio.

Action and Effect and Modification

As explained above, at the time of startup of the internal combustion engine, the wall surface temperature of the combustion chamber 9 is low. Therefore, if injecting fuel from the cylinder injector 12, the injected fuel is hard to vaporize. Therefore, at this time, if increasing the foci injection amount to make the air-fuel ratio of the air-fuel mixture a rich air-fuel ratio, a large number of regions in which concentrations of fuel is locally high are formed, and accordingly the amount of particulate matter produced along with burning of the air-fuel mixture increases. In the present embodiment, during the first control, the air-fuel ratio of the air-fuel mixture supplied to the combustion chamber 9 is made substantially the stoichiometric air-fuel ratio, and therefore an increase in the particulate matter can be suppressed.

On the other hand, in the present embodiment, during the second control, the air-fuel ratio of the air-fuel mixture supplied to the combustion chamber 9 is made a rich air-fuel ratio (air-fuel ratio smaller than stoichiometric air-fuel ratio). In particular, in the present embodiment, the second control is performed from the second cycle after startup of the internal combustion engine 100. Therefore, the second control is started relatively early after startup of the internal combustion engine 100. As a result, after startup of the internal combustion engine 100, exhaust gas of a rich air-fuel ratio can be made to flow into the exhaust purification catalyst 20 relatively early and accordingly the purification ability of the exhaust purification catalyst 20 can be raised relatively early.

Therefore, according to the internal combustion engine 100 according to the present embodiment, by performing the first control after engine startup, it is possible to secure the engine startup property while, as explained above, it is possible to improve the purification ability of the exhaust purification catalyst 20 and suppress production of particulate matter accompanying burning of the air-fuel mixture.

Note that, in the above embodiment, during the first control, the air-fuel ratio of the air-fuel mixture supplied to the combustion chamber 9 is made substantially the stoichiometric air-fuel ratio. However, if the air-fuel ratio of the air-fuel mixture in the second control is smaller than the air-fuel ratio of the air-fuel mixture in the first control, the air-fuel ratio of the air-fuel mixture in the first control need not be substantially the stoichiometric air-fuel ratio.

Flow Charts

Figure 6:
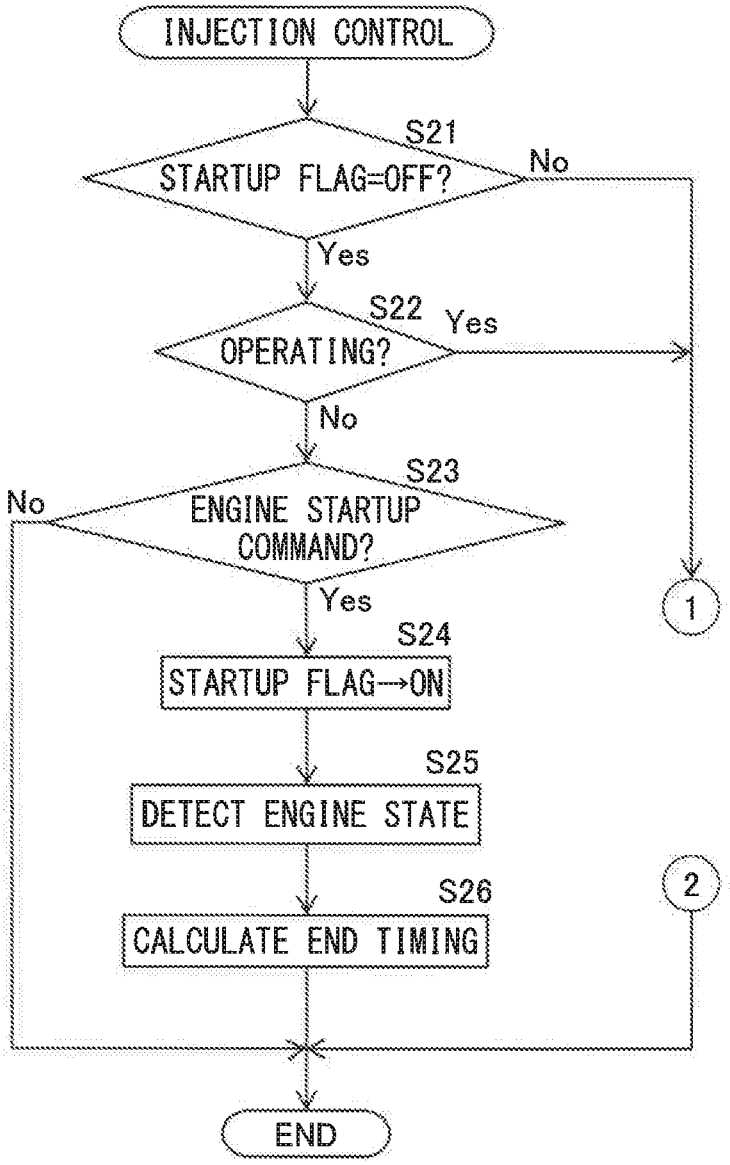
FIG. 6 is part of a flow chart showing a control routine of fuel injection control from two injectors.
Figure 7:
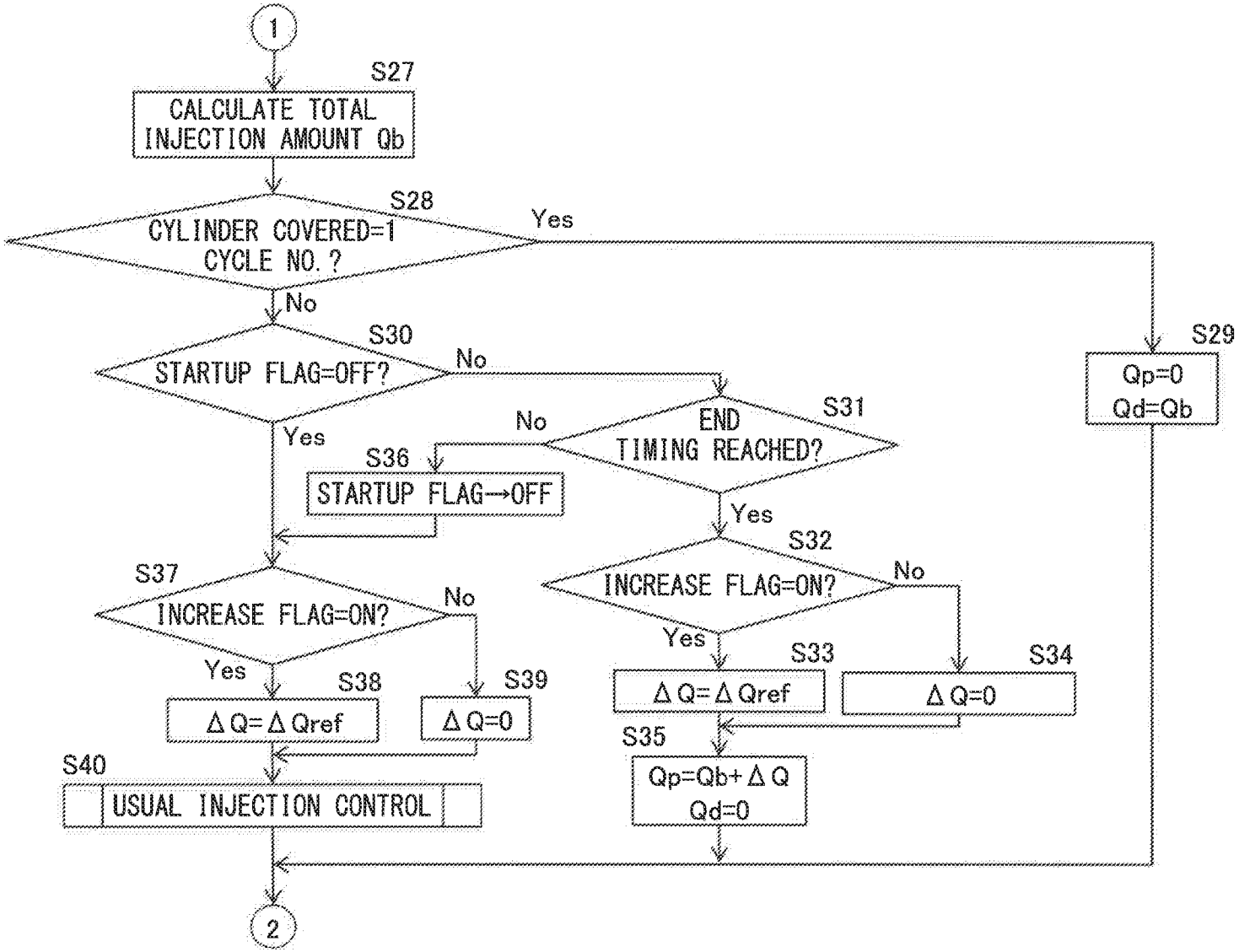
FIG. 7 is part of a flow chart showing a control routine of fuel injection control from two injectors.

FIGS. 6 and 7 are flow charts showing a control routine of control for fuel injection from the two injectors 11, 12. The illustrated control routine is performed every constant time interval.

First, at step S21, it is judged if a startup flag has been set to OFF. A "startup flag" is a flag which is set to ON when the internal combustion engine 100 has been started up and the startup injection control shown in FIGS. 4 and 5 is being performed and which is set to OFF at other times. If at step S21 it is judged that the startup flag is OFF, the control routine proceeds to step S22.

At step S22, it is judged if the internal combustion engine 100 is being operated. When at step S22 it is judged that the internal combustion engine 100 is stopped, the control routine proceeds to step S23.

At step S23, it is judged if a command for startup of the internal combustion engine 100 was issued from the ECU 31. A command for startup of the internal combustion engine 100 is, for example, issued from the ECU 31 when the ignition switch of the vehicle mounting the internal combustion engine 100 is set to ON or when the accelerator pedal 43 is depressed while the internal combustion engine 100 is stopped. When at step S23 it is judged that no command for startup of the internal combustion engine 100 has been issued from the ECU 31, the control routine is ended. On the other hand, when at step S23 it is judged that a command for startup of the internal combustion engine 100 has been issued from the ECU 31, the control routine proceeds to step S24.

At step S24, the startup flag is set to ON. Next, at step S25, the state of the internal combustion engine 100 right before startup of the internal combustion engine 100 is detected or calculated. Specifically, for example, the temperature of the cooling water of the internal combustion engine 100 is detected by the temperature sensor 41 and the time elapsed from when the internal combustion engine 100 was stopped the previous time is calculated by the ECU 31.

Next, at step S26, the end timing of the startup injection control, that is, the end timing of the second control injecting fuel from only the intake injector, is calculated based on the state of the internal combustion engine 100 detected or calculated at step S25. The end timing of the startup injection control is made a timing at which the wall surface temperature of the combustion chamber 9 reaches the reference temperature Tref. Therefore, as the wall surface temperature of the combustion chamber 9 at the time of startup of the internal combustion engine 100 is lower, the end timing of the startup injection control is set to a later timing.

Specifically, for example, as the temperature of the cooling water of the internal combustion engine 100 is lower, the end timing of the startup injection control is set to a later timing, and as the time elapsed from when the internal combustion engine 100 was stopped the previous time is longer, the end timing of the startup injection control is set to a later timing. Further, for example, when the time elapsed from when the internal combustion engine 100 was stopped the previous time is short, the wall surface temperature of the combustion chamber 9 is equal to or higher than the reference temperature Tref at the time of startup of the internal combustion engine 100. Therefore, in such a case, there is no need to perform startup injection control and accordingly the current time is set as the end timing of the startup injection control.

At the next control routine, it is judged that at step S21 the startup flag was set to ON and the control routine proceeds from step S21 to S27. At step S27, the total fuel injection amount Qb is calculated in the same way as step S1 of FIG. 3.

Next, at step S28, it is judged if the cylinder for which the fuel injection amount is calculated is in the compression stroke of the first cycle after startup of the internal combustion engine 100. If it is judged that the cylinder for which the fuel injection amount is calculated is in the compression stroke of the first cycle, the control routine proceeds to step S29. At step S29, the port injection amount Qp is set to 0, the cylinder injection amount Qd is set to the total fuel injection amount Qb calculated at step S27, and the control routine is made to end. As a result, the first control feeding fuel into the combustion chamber 9 by fuel injection from the cylinder injector 12 is performed. Note that, at step S29, correction for increasing the total fuel injection amount is not performed.

Then, if the internal combustion engine 100 turns a plurality of times, the cylinder for which the fuel injection amount is calculated is in the compression stroke of the second cycle after startup of the internal combustion engine 100. Therefore, at the next control routine, it is judged that the cylinder covered at step S28 is not in the compression stroke of the first cycle and the control routine proceeds to step S30.

At step S30, it is judged if the startup flag has been set to OFF. Right after the second cycle starts after the internal combustion engine 100 is started up, the startup flag is set to ON, and therefore the control routine proceeds to step S31.

At step S31, it is judged if the current time has reached the end timing set at step S26. If at step S31 it is judged that the current time has not reached the end timing, the control routine proceeds to step S32.

At step S32, it is judged if an increase flag is set to ON. An "increase flag" is a flag which is set to ON when the total fuel injection amount is set so that the air-fuel ratio of the air-fuel mixture fed to the combustion chamber 9 at the time of engine startup is a rich air-fuel ratio, and is set to OFF at other times. The increase flag is set by the control for setting the increase flag shown in FIG. 8.

When at step S32 it is judged that the increase flag is set to ON, the control routine proceeds to step S33. At step S33, the injection correction amount ΔQ is set to a positive predetermined amount ΔQref. Note that, the injection correction amount ΔQ may also, for example, be set to gradually decrease over a constant time period from startup of the internal combustion engine 100, and may be set so as to change in accordance with the operating state of the internal combustion engine 100. On the other hand, if at step S32 it is judged that the increase flag is set to OFF, the control routine proceeds to step S34. At step S34, the injection correction amount ΔQ is set to 0.

Next, at step S35, the port injection amount Qp is set to the total fuel injection amount Qb plus the injection correction amount ΔQ (Qp=Qb+ΔQ), the cylinder injection amount Qd is set to 0, and the control routine is ended. As a result, the second control is performed for feeding fuel to the combustion chamber 9 by fuel injection from the intake injector 11.

Then, if the current time reaches the end timing set at step S26, the next control routine proceeds from step S31 to step S36. At step S36, the startup flag is set to OFF. Therefore, in the following control routines, the first control and second control are not performed. Note that, if at step S26 the wall surface temperature of the combustion chamber 9 is equal to or higher than the reference temperature Tref at the time of startup of the internal combustion engine 100 and the end timing of the startup injection control is set to an early timing, the startup flag is set to OFF at step S36 without going through steps S32 to S35 after startup of the internal combustion engine 100. Therefore, when, in the present embodiment, it is estimated that the wall surface temperature of the combustion chamber 9 is equal to or higher than the reference temperature Tref at the time of startup of the internal combustion engine 100, the second control is not performed after startup of the internal combustion engine 100.

Next, at step S37, it is judged if the increase flag has been set to ON. If at step S37 it is judged that the increase flag has been set to ON, the control routine proceeds to step S38. At step S38, the injection correction amount ΔQ is set to a positive predetermined amount ΔQref. Note that, the injection correction amount ΔQ may also be set so as to change in accordance with the time elapsed from the start of increase or the operating state of the internal combustion engine 100.

On the other hand, when at step S37 it is judged that the increase flag has been set to OFF, the control routine proceeds to step S39. At step S39, the injection correction amount ΔQ is set to 0. Next, at step S40, the normal injection control shown in FIG. 3 is performed and the control routine is ended.

Note that, in the above embodiment, at step S26, the end timing of the startup injection control is calculated and if this end timing is reached, the startup injection control is ended. However, the timing at which the wall surface temperature of the combustion chamber 9 reaches the reference temperature Tref changes in accordance with not only the wall surface temperature of the combustion chamber 9 at the time of startup of the internal combustion engine 100, but also the state of combustion of the air-fuel mixture in the combustion chamber 9 after startup of the internal combustion engine 100. For example, if the engine load is high and the total fuel injection amount is great, the heat energy accompanying burning of the air-fuel mixture in the combustion chamber 9 is great and accordingly the wall surface temperature of the combustion chamber 9 greatly rises.

Therefore, the end timing of startup injection control may be set based not only on the stale of the internal combustion engine 100 at the time of startup, but also other parameters changing after startup of the internal combustion engine 100. Other parameters includes, for example, the total fuel injection amount after startup of the internal combustion engine 100 or the cumulative value of the same.

Figure 8:
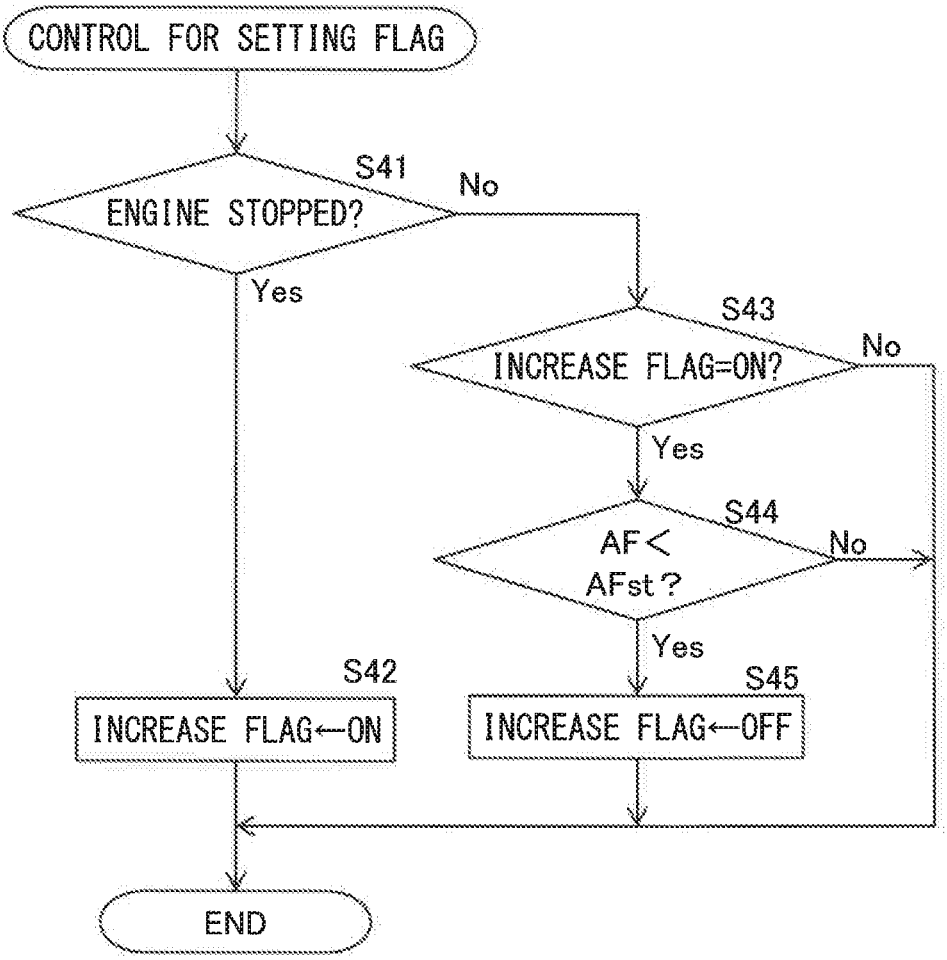
FIG. 8 is a flow chart showing a control routine of control for setting an increase flag.

FIG. 8 is a flow chart showing a control routine of control for setting the increase flag. The illustrated control routine is performed every constant time interval.

First, at step S41, it is judged if the internal combustion engine 100 is stopped. If it is judged that the internal combustion engine 100 is stopped, the control routine proceeds to step S42. At step S42, the increase flag is set to ON and the control routine is ended.

On the other hand, if at step S41 it is judged that the internal combustion engine 100 is not stopped, the routine proceeds to step S43. At step S43, it is judged if the increase flag is set to ON. If at step S43 it is judged that the increase flag is set to ON, the control routine proceeds to step S44.

At step S44, it is judged if the air-fuel ratio AF detected by the downstream side air-fuel ratio sensor (not shown) arranged at the downstream side of the exhaust purification catalyst 20 is lower than the stoichiometric air-fuel ratio AFst (that is, if it is a rich air-fuel ratio). If the oxygen storage amount of the exhaust purification catalyst 20 becomes substantially zero, the unburned HC, CO, etc., in the exhaust gas flowing into the exhaust purification catalyst 20 flow out without being removed at the exhaust purification catalyst 20, and therefore the air-fuel ratio of the exhaust gas flowing out from the exhaust purification catalyst 20 becomes the rich air-fuel ratio. Therefore, it is learned that if the air-fuel ratio AF detected by the downstream side air-fuel ratio sensor becomes the rich air-fuel ratio, the oxygen storage amount of the exhaust purification catalyst 20 becomes substantially zero.

If at step S44 it is judged that the air-fuel ratio AF detected by the downstream side air-fuel ratio sensor is equal to or higher than the stoichiometric air-fuel ratio AFst, the control routine is ended while the increase flag remains set to ON. On the other hand, if at step S44 it is judged that the air-fuel ratio AF detected by the downstream side air-fuel ratio sensor is lower than the stoichiometric air-fuel ratio AFst, the control routine proceeds to step S45. At step S45, the increase flag is set to OFF and the control routine is ended.

If the increase flag is set to OFF, at the subsequent control routine, at step S43, it is judged that the increase flag is not set to ON and then the control routine is ended. Therefore, the increase flag is maintained as OFF until the internal combustion engine 100 is next stopped.

Note that, in the above embodiment, when the air-fuel ratio AF detected by the downstream side air-fuel ratio sensor has become a rich air-fuel ratio, the increase flag is set to OFF to change the air-fuel ratio of the air-fuel mixture from the rich air-fuel ratio to the stoichiometric air-fuel ratio. However, the timing of setting the increase flag to OFF may be another timing as well. For example, it is also possible to estimate the oxygen storage amount of the exhaust purification catalyst 20 based on the air-fuel ratio detected by the air-fuel ratio sensor 42 arranged at the upstream side of the exhaust purification catalyst 20 and set the increase flag to OFF when the estimated oxygen storage amount reaches a predetermined amount (amount greater than 0).

Second Embodiment

Next, referring to FIG. 9, an internal combustion engine according to a second embodiment will be explained. The configuration and control of the internal combustion engine according to the second embodiment are basically similar to the configuration and control of the internal combustion engine according to the first embodiment. Therefore, below, parts different from the internal combustion engine according to the first embodiment will be focused on in the explanation.

In the above-mentioned first embodiment, the startup injection control performs the first control to form an air-fuel mixture in the combustion chamber 9 by fuel injection from the cylinder injector 12 in only the first cycle after startup of the internal combustion engine 100 and performs the second control to form an air-fuel mixture in the combustion chamber 9 by fuel injection from the intake injector 12 in and after the second cycle. Differently from the first embodiment, in the present embodiment, the startup injection control is designed to start the fuel injection from the intake injector 11 simultaneously with startup of the internal combustion engine 100. However, even if starting fuel injection from the intake injector 11 simultaneously with startup of the internal combustion engine 100, in some of the cylinders, the fuel will not be supplied timely enough. Therefore, fuel injection from the cylinder injector 12 is performed only for a cylinder which would not be supplied with fuel timely enough by fuel injection from the intake injector 11 right after startup of the internal combustion engine 100.

In other words, in the present embodiment, the first control is performed to form an air-fuel mixture in the combustion chamber 9 by fuel injection from the cylinder injector 12 before the air-fuel mixture in the combustion chamber 9 is formed by fuel injected from the intake injector 11 right after engine startup. Further, the second control is performed after the air-fuel mixture in the combustion chamber 9 is formed by fuel injected from the intake injector 11 right after engine startup.

Figure 9:
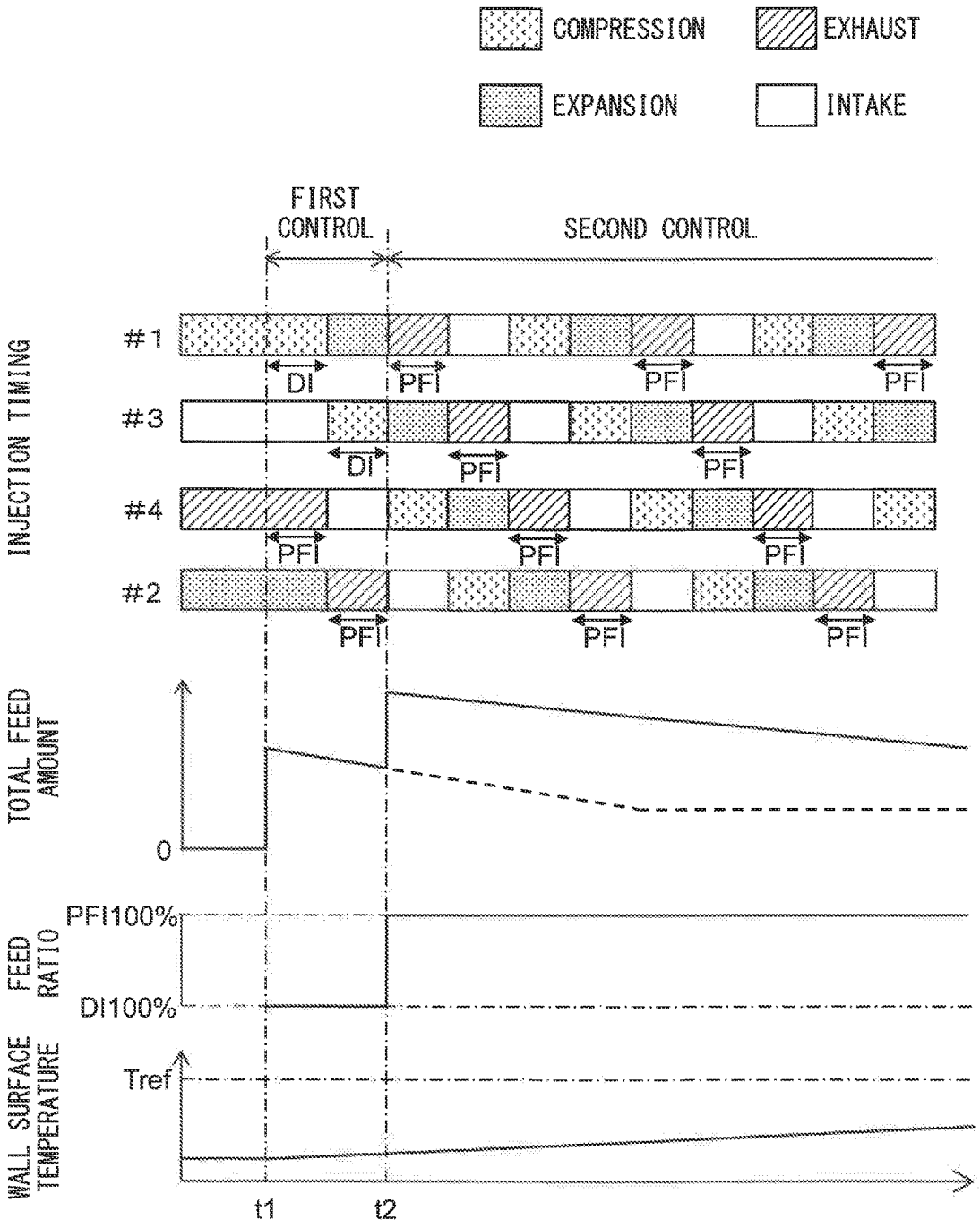
FIG. 9 is a time chart, similar to FIG. 5, of fuel injection timing and other parameters, at an initial stage of startup of an internal combustion engine.

FIG. 9 is a time chart, similar to FIG. 5, of a fuel injection timing, etc., at an initial stage of startup of an internal combustion engine. In the example shown in FIG. 9, the internal combustion engine 100 is started up at the time t1.

If, at the time t1, the internal combustion engine 100 is started up, at the No. 4 cylinder #4 which had been in the exhaust stroke while the internal combustion engine 100 was stopped, fuel is injected from the intake injector 11. Therefore, after that, when the No. 4 cylinder #3 enters the compression stroke, fuel injected from the intake injector 11 has been supplied to the combustion chamber 9 of the No. 4 cylinder #4.

Next, after the No. 4 cylinder #4, the exhaust stroke arrives at the No. 2 cylinder #2. Therefore, if the exhaust stroke arrives at the No. 2 cylinder #2, fuel is injected from the intake injector 11. Therefore, after that, when the No. 2 cylinder #2 enters the compression stroke, fuel injected from the intake injector 11 has been supplied to the combustion chamber 9 of the No. 2 cylinder #2. Further, in a cylinder where the exhaust stroke arrives after that, fuel is similarly injected from the intake injector 11.

Even if the intake injector 11 injects fuel at the No. 4 cylinder #4 right after the internal combustion engine 100 is started up at the time t1, the No. 4 cylinder #4 will not immediately enter the compression stroke. Therefore, time is taken after the startup of the internal combustion engine 100 until the air-fuel mixture including the fuel injected from the intake injector 11 explodes.

Therefore, in the present embodiment, at the No. 1 cylinder #1 which was in the compression stroke while the internal combustion engine 100 was stopped, fuel is injected from the cylinder injector 12 during the compression stroke. Therefore, the No. 1 cylinder #1 is supplied with fuel injected from the cylinder injector 12 right after engine startup. Further, at the No. 3 cylinder #3 as well, where the compression stroke arrives after the No. 1 cylinder #1, fuel is injected from the cylinder injector 12 during the compression stroke. Therefore, the No. 3 cylinder #3 is supplied with fuel injected from the cylinder injector 12 right after engine startup. That is, the No. 1 cylinder #1 and the No. 3 cylinder #3 are subjected to the first control where the air-fuel mixture of the combustion chamber 9 is formed by the fuel injected from the cylinder injector 12.

At the No. 4 cylinder #4 where the compression stroke arrives after that, fuel is already being supplied from the intake injector 11 at the exhaust stroke, and therefore fuel is not injected from the cylinder injector 12. Therefore, in the No. 4 cylinder 44 or following cylinders, the second control where the air-fuel mixture of the combustion chamber 9 is formed by the fuel injected from the intake injector 11 is performed. As a result, when starting up the internal combustion engine, it is possible to decrease the injection of fuel from the cylinder injector 12 to the maximum extent and accordingly it is possible to keep the exhaust emission from deteriorating to the maximum extent.

Note that, in the first embodiment, fuel is supplied into the combustion chamber 9 by fuel injection from the cylinder injector 12 only at the first cycle after startup of the internal combustion engine 100. Further, in the second embodiment, fuel is supplied into the combustion chamber 9 by fuel injection from the cylinder injector 12 only for a cylinder where fuel cannot be supplied from the intake injector 11 after startup of the internal combustion engine 100.

However, if burning an air-fuel mixture formed by only fuel injected from the cylinder injector until a predetermined timing after startup of the internal combustion engine 100 and burning an air-fuel mixture formed by only fuel injected from the intake injector 11 (or, if considering the later explained fourth embodiment, fuel containing a large amount of fuel injected from the intake injector 11) from the predetermined timing after startup of the internal combustion engine 100, it is also possible to switch from the first control to the second control at another timing. Therefore, for example, it is also possible for the first control to be performed up to the second cycle after startup of the internal combustion engine 100, and for the second control to be performed from the third cycle.

Figure 10:
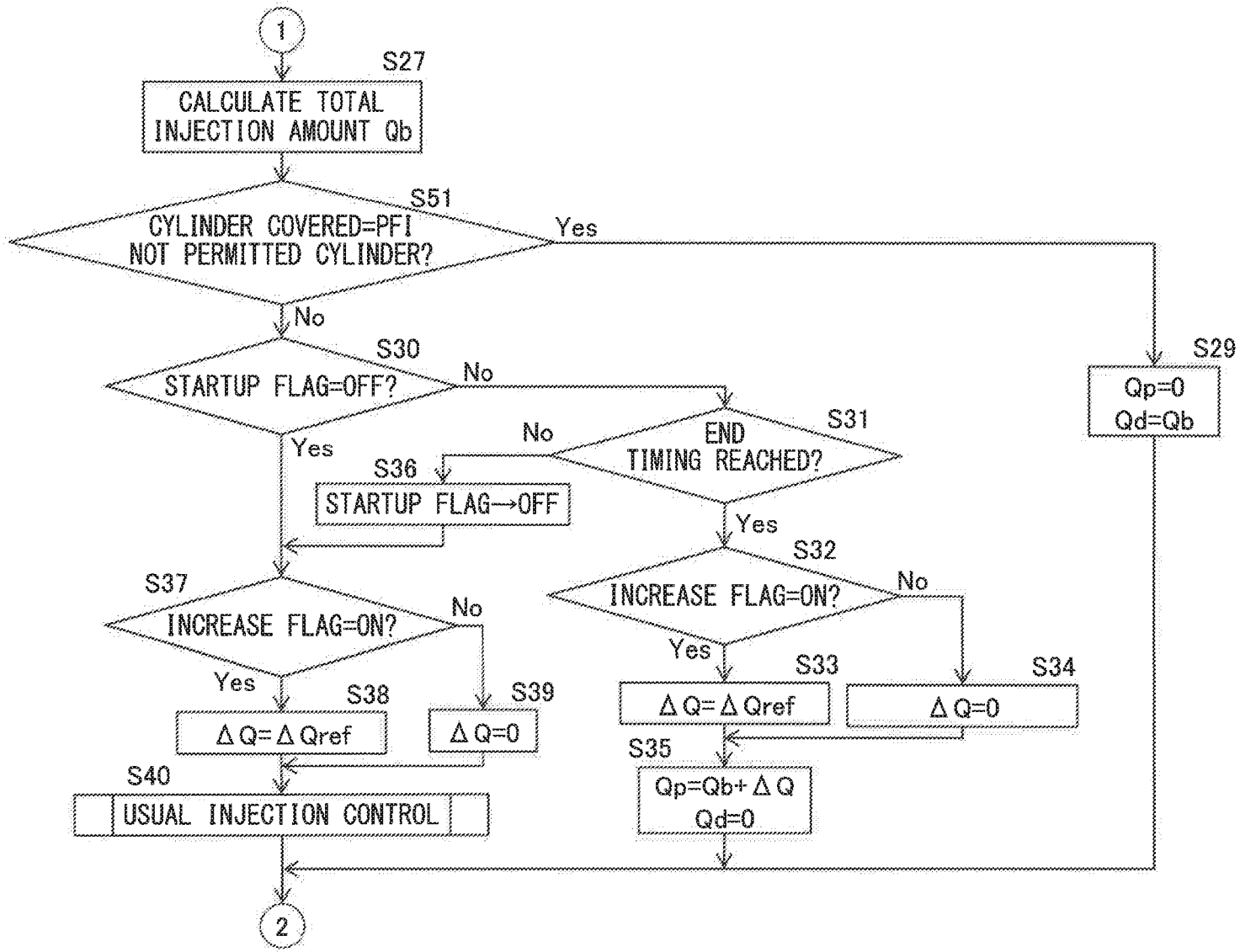
FIG. 10 is part of a flow chart, similar to FIG. 7, showing a control routine of fuel injection control from two injectors.

FIG. 10 is part of a flow chart, similar to FIG. 7, which shows the control routine of control of fuel injection from the two injectors 11, 12. The illustrated control routine is performed every fixed time interval. In FIG. 10, steps similar to the steps of FIG. 7 are assigned the same reference numerals. Explanation of these steps will be omitted.

If at step S27 the total fuel injection amount Qb is calculated, the control routine proceeds to step S51. At step S51, it is judged if the cylinder for which the fuel injection amount is to be calculated is a cylinder not able to be supplied with fuel from the intake injector 11. If at step S51 it is judged that the cylinder for which the fuel injection amount is to be calculated is a cylinder not able to be supplied with fuel from the intake injector 11, the control routine proceeds to step S29 where the first control is performed.

On the other hand, if at step S51 it is judged that the cylinder for which the fuel injection amount is to be calculated is a cylinder able to be supplied with fuel from the intake injector 11, the control routine proceeds to step S30. Therefore, the second control or usual injection control is performed.

Third Embodiment

Next, referring to FIG. 11, an internal combustion engine according to a third embodiment will be explained. The configuration and control of the internal combustion engine according to the third embodiment are basically similar to the configuration and control of the internal combustion engines according to the first and the second embodiments. Therefore, below, parts different from the internal combustion engines according to the first and the second embodiments will be focused on in the explanation.

In the first embodiment, in the startup injection control, the first control is performed in the first cycle after startup of the internal combustion engine 100, while the second control is performed in and after the second cycle (below, such control also being referred to as "first startup injection control"). On the other hand, in the second embodiment, in the startup injection control, the first control is performed before an air-fuel mixture in the combustion chamber 9 is formed by the fuel injected from the intake injector 11 right after engine startup, while the second control is performed after an air-fuel mixture in the combustion chamber 9 is formed by the fuel injected from the intake injector 11 right after engine startup (below, this control also being referred to as the "second startup injection control").

In the present embodiment, as startup injection control, either of the first startup injection control and the second startup injection control is performed in accordance with the state of the internal combustion engine 100 at the time of startup of the internal combustion engine 100. Specifically, for example, if the wall surface temperature of the combustion chamber 9 at the time of startup of the internal combustion engine 100 is equal to or higher than a predetermined switching temperature Tsw less than the reference temperature Tref, as startup injection control, the first startup injection control is performed. On the other hand, if the wall surface temperature of the combustion chamber 9 at the time of startup of the internal combustion engine 100 is less than the switching temperature Tsw, as startup injection control, the second startup injection control is performed.

In this regard, if the wall surface temperature of the combustion chamber 9 at the time of startup of the internal combustion engine 100 is less than the reference temperature Tref but is a relatively high temperature, even if injecting fuel from the cylinder injector 12, the injected fuel relatively easily vaporizes. Therefore, even if continuing the first control for a relatively long time, the exhaust emission will not deteriorate that much. On the other hand, by delaying the switching of the injector performing the fuel injection after startup of the internal combustion engine 100, it is possible to stabilize the combustion of the air-fuel mixture at the time of startup. According to the present embodiment, at this time, the first startup injection control is performed. Accordingly, it is possible to stabilize the combustion of the air-fuel mixture at the time of startup of the internal combustion engine 100 without causing the exhaust emission to deteriorate.

On the other hand, when the wall surface temperature of the combustion chamber 9 at the time of startup of the internal combustion engine 100 is considerably low, if injecting fuel from the cylinder injector 12, the injected fuel is hard to vaporize. According to the present embodiment, at this time, the second startup injection control is performed and accordingly it is possible to keep particulate matter from being produced.

Note that, in the above embodiment, the startup injection control is switched in accordance with the wall surface temperature of the combustion chamber 9 at the time of startup of the internal combustion engine 100. However, the startup injection control may also be switched based on the value of the temperature of the cooling water of the internal combustion engine 100, the time elapsed from when the internal combustion engine 100 was stopped the previous time, and other parameters relating to the wall surface temperature of the combustion chamber 9.

Figure 11:
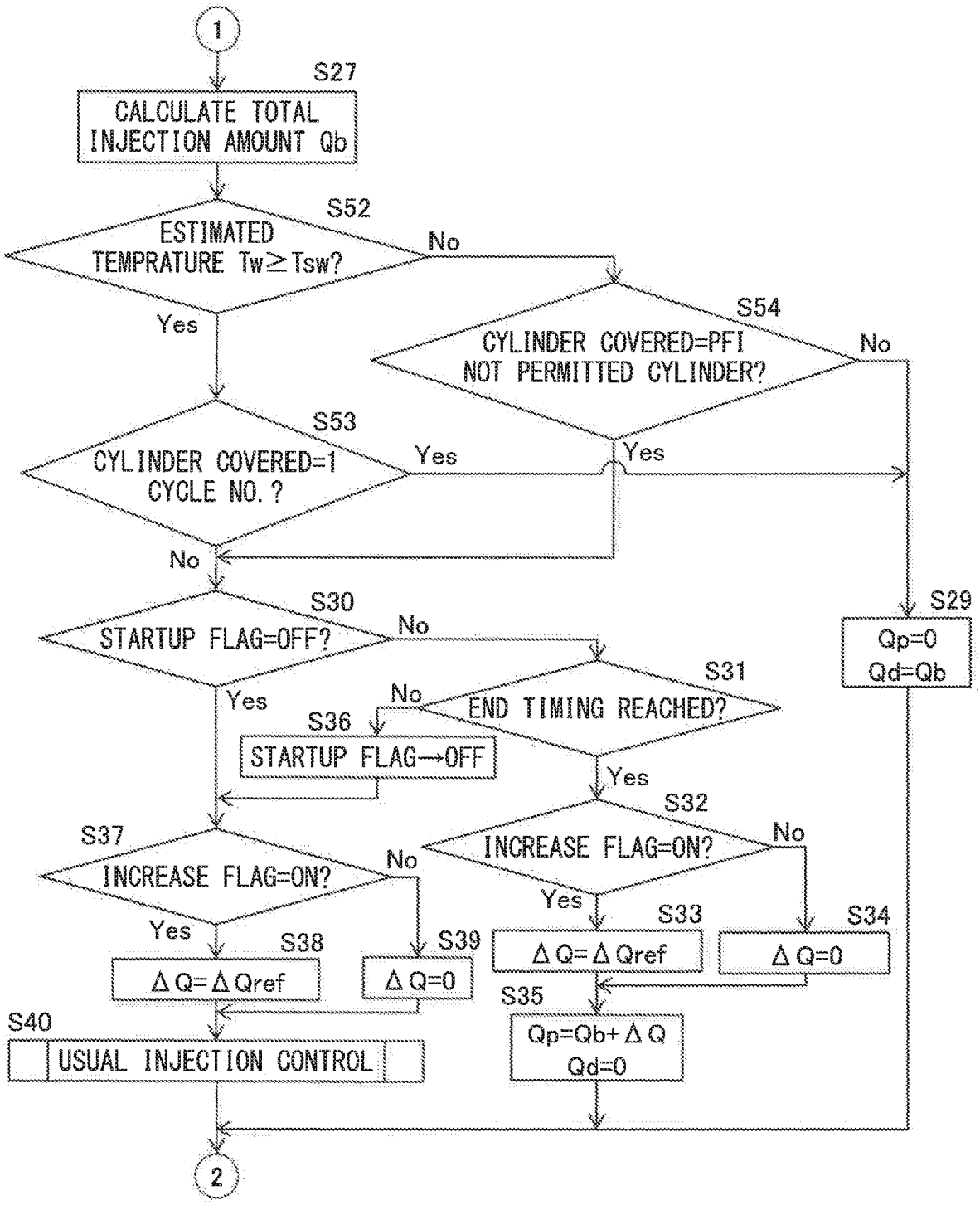
FIG. 11 is part of a flow chart, similar to FIG. 7, showing a control routine of fuel injection control from two injectors.

FIG. 11 is part of a flow chart, similar to FIG. 7, showing a control routine of control of the fuel injection from the two injectors 11, 12. The illustrated control routine is performed every certain time interval. In FIG. 11, steps similar to the steps of FIG. 7 are assigned the same reference numerals and explanations of those steps will be omitted.

If at step S27 the total fuel injection amount Qb is calculated, the control routine proceeds to step S52. At step S52, it is judged if the estimated value Tw of the wall surface temperature of the combustion chamber 9 at the time of startup of the internal combustion engine 100 is equal to or higher than a predetermined switching temperature Tsw. The wall surface temperature of the combustion chamber 9 may be estimated, for example, based on the temperature of the cooling water of the internal combustion engine 100, the time elapsed from when the internal combustion engine 100 was stopped the previous time.

If at step S52 it is judged that the estimated value Tw of the wall surface temperature of the combustion chamber 9 at the time of startup of the internal combustion engine 100 is equal to or higher than a predetermined switching temperature Tsw, the control routine proceeds to step S53. At step S53, in the same way as step S28 of FIG. 7, it is judged if the cylinder for which the fuel injection amount is to be calculated has entered the compression stroke of the first cycle after startup of the internal combustion engine 100. If it is judged that the cylinder has entered the compression stroke of the first cycle, the control routine proceeds to step S29. On the other hand, if it is judged that the cylinder has not entered the compression stroke of the first cycle, the control routine proceeds to step S30.

If at step S52 it is judged that the estimated value Tw of the wall surface temperature of the combustion chamber 9 at the time of startup of the internal combustion engine 100 is less than the switching temperature Tsw, the control routine proceeds to step S54. At step S54, in the same way as step S51 of FIG. 10, it is judged whether the cylinder for which the fuel injection amount is to be calculated is a cylinder which cannot be supplied with fuel from the intake injector 11. If at step S54 it is judged that the cylinder for which the fuel injection amount is to be calculated is a cylinder which cannot be supplied with fuel from the intake injector 11, the control routine proceeds to step S29 where the first control is performed. On the other hand, if at step S54 it is judged that the cylinder for which the fuel injection amount is to be calculated is a cylinder which can be supplied with fuel from the intake injector 11, the control routine proceeds to step S30.

Fourth Embodiment

Next, referring to FIGS. 12 and 13, an internal combustion engine according to a fourth embodiment, will be explained. The configuration and control of the internal combustion engine according to the fourth embodiment are basically similar to the configuration and control of the internal combustion engines according to the first to the third embodiments. Therefore, below, parts different from the internal combustion engines according to the first to the third embodiments will be focused on in the explanation.

In the above first to third embodiments, in the second control, fuel injection from only the intake injector 11 is used to feed fuel into the combustion chamber 9 whereby an air-fuel mixture is formed in the combustion chamber 9. However, in the present embodiment, during second control, fuel is injected from the cylinder injector 12 in accordance with the operating state of the internal combustion engine 100.

Specifically, for example, in the second control, when the engine load is low, fuel is injected only from the intake injector 11. In addition, when the engine load is high, fuel is injected from the cylinder injector 12 in addition to the intake injector 11. In particular, as the engine load becomes higher, the more fuel is injected so that the port injection ratio decreases. However, in the operating states of the internal combustion engine 100, the fuel injections from the two injectors 11, 12 are controlled so that the port injection ratio at the second control is equal to or higher than the port injection rate at the usual injection control. In addition, even when fuel injection is performed from the cylinder injector 12 during the second control, the injection of fuel from the two injectors 11, 12 is controlled so that the port injection ratio is larger than 50%. That is, in the present embodiment, in the second control, the air-fuel mixture in the combustion chamber 9 is formed by fuel containing a larger amount of fuel injected from the intake injector 11 than the amount of fuel injected from the cylinder injector 12.

Figure 12:
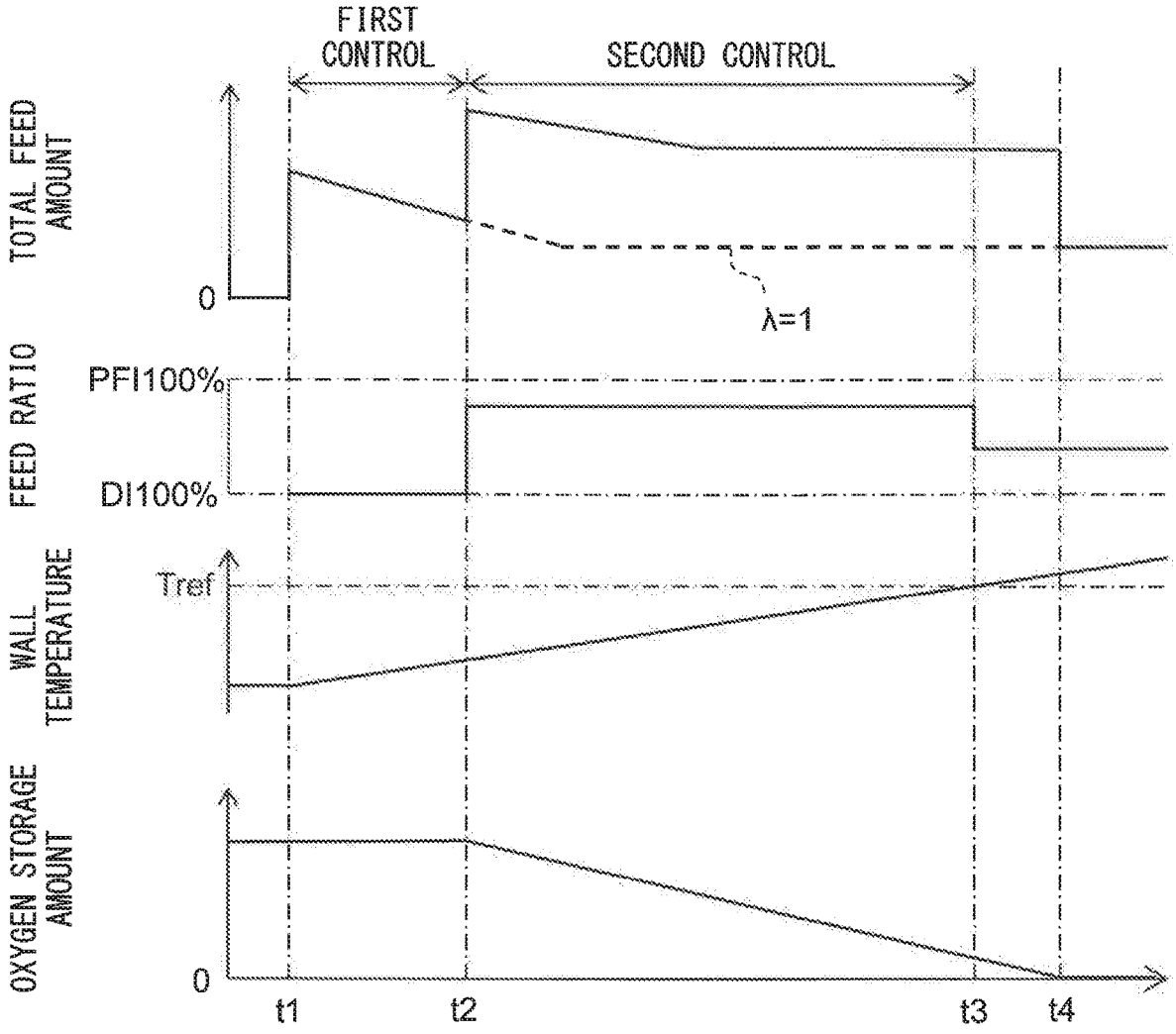
FIG. 12 is a time chart, similar to FIG. 4, of a total fuel feed amount and other parameters, at the time of startup of an internal combustion engine.

FIG. 12 is a time chart, similar to FIG. 4, of the total fuel feed amount, etc., at the time of startup of the internal combustion engine 100. In the example shown in FIG. 12, the second control is performed after the time t2. In the present embodiment, fuel is injected from both of the intake injector 11 and cylinder injector 12 during the second control after the time t2. At this time, the fuel feed ratio from the intake injector 11 is larger than 50%.

Figure 13:
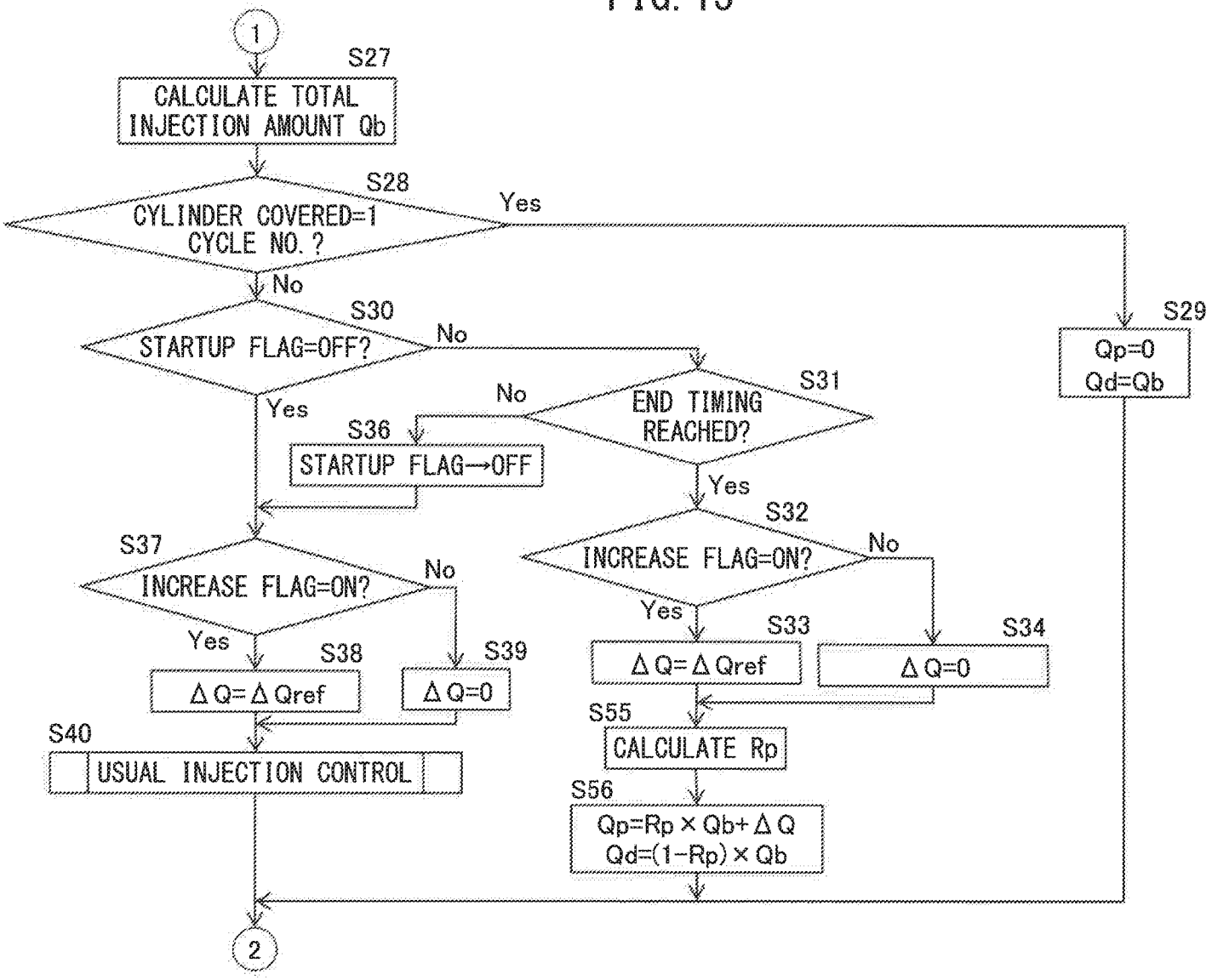
FIG. 13 is part of a flow chart, similar to FIG. 7, showing a control routine of fuel injection control from two injectors.

FIG. 13 is part of a flow chart, similar to FIG. 7, which shows a control routine of control of fuel injection from the two injectors 11, 12. The illustrated control routine is performed at every certain time interval. In FIG. 13, steps similar to the steps of FIG. 7 are assigned the same notations and explanations of these steps are omitted.

If the injection correction amount ΔQ is calculated at step S33 or S34, the control routine proceeds to step S55. At step S55, the port injection ratio Rp is calculated based on the engine load and engine rotational speed using, for example, a map prepared in advance.

Next, at step S56, the port injection amount Qp is calculated by the following formula (3) and the cylinder injection amount Qd is calculated by the following formula (4):

$$Qp=Rp\times Qb+\Delta Q \quad (3)$$

$$Qd=(1-Rp)\times Qb \quad (4)$$

As will be understood from the above formulas (3) and (4), in the present embodiment, the increase of the fuel injection amount equivalent to the injection correction amount ΔQ is performed only for the port injection amount Qp.

The invention claimed is:

1. An internal combustion engine comprising:

a cylinder injector injecting fuel directly into a combustion chamber;

an intake injector injecting fuel into an intake passage; and a control device controlling injection of fuel from these injectors, wherein:

the control device is configured to perform a first control, in which an air-fuel mixture in the combustion chamber is formed by only fuel injected from the cylinder injector, until a predetermined timing after startup of the internal combustion engine, and to perform a second control, in which an air-fuel mixture in the combustion chamber is formed by only fuel injected from the intake injector, at and after the predetermined timing, the air-fuel ratio of the air-fuel mixture during the second control is smaller than the air-fuel ratio of the air-fuel mixture during the first control and smaller than the stoichiometric air-fuel ratio, and the control device is configured to perform the second control so that an end timing of the second control is later as the wall surface temperature of the combustion chamber of the internal combustion engine at the time of the startup of the internal combustion engine is lower.

2. The internal combustion engine according to claim 1, wherein the air-fuel ratio of the air-fuel mixture during the first control is substantially the stoichiometric air-fuel ratio.

3. The internal combustion engine according to claim 1, wherein:

the predetermined timing is the timing at which one cycle is completed after the startup of the internal combustion engine, and the control device is configured to form an air-fuel mixture in the combustion chamber by the first control during a first cycle after the startup of the internal combustion engine, and to form an air-fuel mixture in the combustion chamber by the second control on and after a second cycle after the startup of the internal combustion engine.

4. The internal combustion engine according to claim 1, wherein:

the predetermined timing is a timing before an air-fuel mixture is formed by fuel injected from the intake injector right after engine startup, and the control device is configured to perform the first control before an air-fuel mixture in the combustion chambers is formed by fuel injected from the intake injector right after the engine startup, and perform the second control after an air-fuel mixture in the combustion chambers is formed by fuel injected from the intake injector right after the engine startup.

5. The internal combustion engine according to claim 1, wherein:

the control device is configured to be able to perform first startup injection control performing the first control during a first cycle after the startup of the internal combustion engine and performing the second control at a second cycle on and after the startup of the internal combustion engine, and second startup injection control performing the first control before an air-fuel mixture in the combustion chamber is formed by fuel injected from the intake injector right after engine startup and performing the second control after an air-fuel mixture in the combustion chamber is formed by fuel injected from the intake injector right after the engine startup, and the control device is configured to perform one of the first startup injection control and the second startup injection control at the time of the startup of the internal combustion engine according to a state of the internal combustion engine at the time of startup of the internal combustion engine.

6. The internal combustion engine according to claim 1, wherein the control device is configured to determine the end timing of the second control in accordance with a total fuel injection amount from the two injectors after the startup of the internal combustion engine.

7. The internal combustion engine according to claim 1, wherein the control device is configured so that when, at the time of the startup of the internal combustion engine, it is estimated that the temperature of the wall surface of the combustion chamber of the internal combustion engine is equal to or higher than a predetermined temperature, the second control is not performed after the startup of the internal combustion engine.

* * * * *